US011438713B2

(12) United States Patent
Udesen et al.

(10) Patent No.: US 11,438,713 B2
(45) Date of Patent: Sep. 6, 2022

(54) BINAURAL HEARING SYSTEM WITH LOCALIZATION OF SOUND SOURCES

(71) Applicant: GN Hearing A/S, Ballerup (DK)

(72) Inventors: Jesper Udesen, Måløv (DK); Karl-Fredrik Johan Gran, Limhamn (SE)

(73) Assignee: GN HEARING A/S, Ballerup (DK)

( * ) Notice: Subject to any disclaimer, the term of this patent is extended or adjusted under 35 U.S.C. 154(b) by 0 days.

(21) Appl. No.: 16/130,780

(22) Filed: Sep. 13, 2018

(65) Prior Publication Data

US 2019/0110137 A1 Apr. 11, 2019

(30) Foreign Application Priority Data

Oct. 5, 2017 (EP) ..... 17194985

(51) Int. Cl.
*H04R 25/00* (2006.01)
*H04R 1/10* (2006.01)

(52) U.S. Cl.
CPC ..... *H04R 25/552* (2013.01); *H04R 25/407* (2013.01); *H04R 25/554* (2013.01); *H04R 25/558* (2013.01); *H04R 1/1083* (2013.01); *H04R 2225/41* (2013.01); *H04R 2225/43* (2013.01); *H04S 2420/01* (2013.01)

(58) Field of Classification Search
CPC ..... H04R 25/552; H04R 25/407; H04R 25/554; H04R 25/558; H04R 2225/41; H04R 2225/43; H04R 2420/01; H04R 1/1083; H04S 2420/01
USPC ..... 381/23.1
See application file for complete search history.

(56) References Cited

U.S. PATENT DOCUMENTS

| | | | | |
|---|---|---|---|---|
| 8,654,998 | B2 | 2/2014 | Nomura et al. | |
| 9,113,247 | B2 | 8/2015 | Chatlani et al. | |
| 9,980,055 | B2 | 5/2018 | Jensen et al. | |
| 10,181,328 | B2 | 1/2019 | Jensen et al. | |
| 10,431,239 | B2 | 10/2019 | Jensen et al. | |
| 2004/0037442 | A1* | 2/2004 | Nielsen | H04R 25/552 381/315 |
| 2011/0103626 | A1 | 5/2011 | Bisgaard et al. | |
| 2011/0293108 | A1* | 12/2011 | Mejia | H04R 25/407 381/92 |
| 2013/0094683 | A1* | 4/2013 | Hansen | G09B 21/04 381/309 |

(Continued)

FOREIGN PATENT DOCUMENTS

| | | |
|---|---|---|
| CN | 102428716 | 4/2012 |
| CN | 102428717 | 4/2012 |

(Continued)

OTHER PUBLICATIONS

Foreign Office Action dated Mar. 30, 2021 for related Chinese Patent Appln. No. 201811157433.2.

(Continued)

*Primary Examiner* — Daniel R Sellers
(74) *Attorney, Agent, or Firm* — Vista IP Law Group, LLP

(57) ABSTRACT

A new hearing aid is provided in which signals that are received from an external device, such as a spouse microphone, a media player, a hearing loop system, a teleconference system, a radio, a TV, a telephone, a device with an alarm, etc., are filtered in such a way that a user can localize the monaural signal transmitter.

24 Claims, 3 Drawing Sheets

(56) References Cited

U.S. PATENT DOCUMENTS

| | | | | |
|---|---|---|---|---|
| 2013/0259237 | A1* | 10/2013 | Oesch | H04R 25/407 381/2 |
| 2015/0156592 | A1 | 6/2015 | Jensen | |
| 2015/0289063 | A1* | 10/2015 | Ma | H04R 25/50 381/321 |
| 2016/0112811 | A1* | 4/2016 | Jensen | H04R 5/033 381/17 |
| 2016/0367805 | A1 | 12/2016 | Dietz et al. | |
| 2017/0105074 | A1* | 4/2017 | Jensen | H04R 25/405 |
| 2018/0020298 | A1* | 1/2018 | Courtois | H04R 25/554 |

FOREIGN PATENT DOCUMENTS

| | | |
|---|---|---|
| CN | 102771144 | 11/2012 |
| CN | 104980869 | 10/2015 |
| CN | 105530580 | 4/2016 |
| CN | 105744455 A | 7/2016 |
| CN | 107071674 | 8/2017 |
| EP | 3013070 | 4/2016 |
| EP | 3041270 | 7/2016 |
| EP | 3157268 | 4/2017 |
| JP | 2017-085362 | 5/2017 |
| JP | 2007336460 A | 12/2017 |

OTHER PUBLICATIONS

Translation of Mar. 20, 2021 Office Action issued for Chinese Patent Application No. 201811157433.2.

"Robust bianural sound source localization algorithm based on subband signal-to-noise ratio estimation and soft judgments".

English translation of search report for Chinese patent application No. 201811157433.2.

Foreign OA for CN Patent Appln. No. 201811157433.2 dated Mar. 30, 2021.

Anonymous, "Cross-Correlation," Wikipedia, Feb. 25, 2013, pp. 1-4, XP055548102, URL: https://en.wikipedia.org/v/index.php?title=Cross-correlation& 01d.

Foreign Office Action with translation dated Jan. 11, 2022 issued for Japanese patent application No. 2018-189501.

* cited by examiner

BINAURAL HEARING SYSTEM WITH LOCALIZATION OF SOUND SOURCES

RELATED APPLICATION DATA

This application claims priority to, and the benefit of, European Patent Application No. 17194985.2 filed on Oct. 5, 2017. The entire disclosure of the above application is expressly incorporated by reference herein.

FIELD

A binaural hearing system is provided with improved localization of a sound source emitting sound that is propagating as an acoustic wave to the binaural hearing system, wherein the sound is also converted to an electronic monaural signal that is transmitted wired or wirelessly to the binaural hearing system. A corresponding method is also provided.

BACKGROUND

Hearing impaired individuals often experience at least two distinct problems:

1) A hearing loss, which is an increase in hearing threshold level, and

2) A loss of ability to understand speech in noise in comparison with normal hearing individuals. For most hearing impaired patients, the performance in speech-in-noise intelligibility tests is worse than for normal hearing people, even when the audibility of the incoming sounds is restored by amplification. Speech reception threshold (SRT) is a performance measure for the loss of ability to understand speech, and is defined as the signal-to-noise ratio required in a presented signal to achieve 50 percent correct word recognition in a hearing in noise test.

In order to compensate for hearing loss, today's digital hearing aids typically use multi-channel amplification and compression signal processing to restore audibility of sound for a hearing impaired individual. In this way, the patient's hearing ability is improved by making previously inaudible speech cues audible.

However, loss of ability to understand speech in noise, including speech in an environment with multiple speakers, remains a significant problem of many humans, including humans that do not use hearing aids.

One tool available for increasing the signal to noise ratio of speech originating from a specific speaker is to equip the speaker in question with a microphone included in a device often referred to as a spouse microphone. The spouse microphone picks up speech from the speaker in question with a high signal to noise ratio due to its proximity to the speaker. The spouse microphone converts the speech into a corresponding electronic monaural signal with a high signal to noise ratio and emits the signal, preferably wirelessly, to a hearing device, typically an earphone or a hearing aid. In this way, a speech signal is provided to the user with a signal to noise ratio well above the SRT of the user in question.

Another way of increasing the signal to noise ratio of speech from a speaker that a human desires to listen to, such as a speaker addressing a number of people in a public place, e.g. in a church, an auditorium, a theatre, a cinema, etc., or through a public address systems, such as in a railway station, an airport, a shopping mall, etc., is to use a telecoil to magnetically pick up audio signals generated, e.g., by telephones, FM systems (with neck loops), and induction loop systems (also called "hearing loops"). In this way, sound may be transmitted to hearing devices, typically hearing aids, with a high signal to noise ratio well above the SRT of the human listeners.

More recently, hearing aids and head-sets have been equipped with radio circuits for reception of radio signals for reception of streamed audio in general, such as streamed music and speech from media players, such as MP3-players, TV-sets, etc.

Hearing aids and head-sets have also emerged that connect with various sources of audio signals through a short-range network, e.g. including Bluetooth technology, e.g. to interconnect hearing aids with cellular phones, audio head-sets, computer laptops, personal digital assistants, digital cameras, etc. Other radio networks have also been suggested, such as HomeRF, DECT, PHS, Wireless LAN (WLAN), or other proprietary networks.

However, in a situation in which a user of a conventional binaural hearing system desires to listen to more than one electronic monaural signals simultaneously, the user typically finds it difficult to separate one signal source from another.

Binaural hearing systems typically reproduce sound in such a way that the user perceives sound sources to be localized inside the head. The sound is said to be internalized rather than being externalized.

A common complaint for hearing system users when referring to the "hearing speech in noise problem" is that it is very hard to follow anything that is being said even though the signal to noise ratio (SNR) should be sufficient to provide the required speech intelligibility. A significant contributor to this fact is that the hearing system reproduces an internalized sound field. This adds to the cognitive loading of the user and may result in listening fatigue and ultimately that the user removes the hearing system.

SUMMARY

Thus, there is a need for a binaural hearing system with improved localization of sound sources associated with respective monaural signal transmitters. Each of the sound sources is emitting sound that is propagating as an acoustic wave to the binaural hearing system, and each of the sound sources is associated with a monaural signal transmitter that is adapted for converting the sound to an electronic monaural signal that is transmitted wired or wirelessly to the binaural hearing system so that the binaural hearing system can reproduce the sound based on the electronic monaural signal.

In the following, the term "monaural signal transmitter" denotes a device that is adapted to forward the electronic monaural signal, wired or wirelessly, typically wirelessly, to the binaural hearing system. The binaural hearing system is adapted to receive and convert the electronic monaural signal into a signal that is presented to the ears of a user of the binaural hearing system so that the user can hear the sound.

In a first type of monaural signal transmitters, the monaural signal transmitter has one or more microphones for reception of sound emitted by the sound source associated with the monaural signal transmitter and for conversion of the received sound into the electronic monaural signal for transmission to the binaural hearing system that is adapted for reproducing the sound from the electronic monaural signal. The sound source is associated with this type of monaural signal transmitter when the one or more microphones of the monaural signal transmitter is placed proximal to the sound source, whereby the sound is recorded by the one or more microphones with a high signal-to-noise ratio. For example, the monaural signal transmitter may be a spouse microphone worn by a human. The spouse microphone is worn close to the human's mouth so that speech from the human is recorded by the spouse microphone with very little attenuation. Possibly, the spouse microphone has a directional microphone so that sound from other directions than the human's mouth is attenuated. Therefore, the spouse microphone obtains speech from the human with a very high signal-to-noise ratio. Contrary to this, the sound that propagates as an acoustic wave to the binaural hearing system is attenuated as a function of the squared distance between the human and the binaural hearing system. Further, the sound is detected by microphones of the binaural hearing system together with possible sound from other sound sources in the sound environment of the user. Therefore, the signal-to-noise ratio of the electronic monaural signal is typically much higher than the signal-to-noise ratio of sound received by the microphones of the binaural hearing system.

Examples of a monaural signal transmitter of the first type, include the above-mentioned spouse microphone, a speaker system with a microphone for picking up speech from a speaker addressing a number of people in an audience, e.g. in a church, an auditorium, a theatre, a cinema, etc., such as an FM system (with neck loops), induction loop system (also called "hearing loops"), etc.

In a second type of the monaural signal transmitter, such as a radio, a TV, a DVD player, a media player, a computer, a telephone, a teleconference system, a device with an alarm, etc., the monaural signal transmitter has one or more loudspeakers that convert a source signal to sound that propagates as an acoustic wave to the binaural hearing system and thus, the monaural signal transmitter of this type also comprises the sound source. The monaural signal transmitter of this type generates the electronic monaural signal based on the source signal that is converted into the sound, and thus, the sound source is associated with this type of monaural signal transmitter by being supplied by the source signal that is also encoded into the electronic monaural signal.

The monaural signal transmitter may include a streaming unit for transmission of digital sound, i.e. sound that has been digitized into a digital sound signal.

For simplicity throughout the present disclosure, the label "electronic monaural signal" is used to identify the electronic monaural signal in any analogue or digital form along the signal path of the electronic monaural signal from the output generating the electronic monaural signal to its final destination.

For example in a spouse microphone, the electronic monaural signal may be generated as an analogue microphone output signal that may be encoded and modulated for wireless transmission to the binaural hearing system. In the binaural hearing system, the electronic monaural signal is demodulated and decoded and filtered and finally converted into a signal, e.g. an acoustic signal, which can be heard by the user of the binaural hearing system. The same label "electronic monaural signal" is used for the signal throughout its signal path in any of its various forms.

In the following, the terms direction towards the sound source, and the direction of arrival (DOA) of sound originating from the sound source, in short just the DOA, denote the direction from the user wearing the binaural hearing system towards the sound source, e.g., with reference to the forward looking direction of the user.

For example, the sound source may be a human wearing a monaural signal transmitter of the first type, e.g. a spouse microphone, that converts the human's speech into an electronic monaural signal for wireless transmission to the binaural hearing system so that the speech of the human both propagates as an acoustic wave to the binaural hearing system for reception and detection by microphones of the binaural hearing system and is encoded into the electronic monaural signal for wireless transmission to the binaural hearing system for reception by a wireless monaural signal receiver of the binaural hearing system for subsequent reproduction of the sound.

In this example, the DOA is the direction from the user of the binaural hearing system towards the human's lips, e.g., with reference to the forward looking direction of the user of the binaural hearing system.

Azimuth of the DOA is the perceived angle $\phi$ of direction towards the sound source associated with the monaural signal transmitter projected onto the horizontal plane with reference to the forward looking direction of the user. The forward looking direction is defined by a virtual line drawn through the centre of the user's head and through a centre of the nose of the user. Thus, a sound source located in the forward looking direction of the user has an azimuth value of $\phi=0°$, and a sound source located directly in the opposite direction has an azimuth value of $\phi=180°$. A sound source located in the left side of a vertical plane perpendicular to the forward looking direction of the user has an azimuth value of $\phi=-90°$, while a sound source located in the right side of the vertical plane perpendicular to the forward looking direction of the user has an azimuth value of $\phi=+90°$.

In the following, the term "the user" means "the user of the binaural hearing system".

A binaural hearing system is provided that is capable of adding spatial cues to respective electronic monaural signals, wherein the respective spatial cues correspond to the DOA of sound that has propagated as an acoustic wave to the binaural hearing system, and wherein the sound is also reproduced in the binaural hearing system based on the received electronic monaural signal.

In the binaural hearing system, electronic monaural signals originating from different monaural signal transmitters are presented to the ears of the user in such a way that the user perceives the respective sound sources to be positioned in their current respective estimated DOAs in the sound environment of the user.

In this way, the human's auditory system's binaural signal processing is utilized to improve the user's capability of separating signals from different monaural signal transmitters and of focussing his or her attention and listening to sound reproduced from a desired one of the electronic monaural signals, or simultaneously listen to and understand sound reproduced from more than one of the electronic monaural signals.

Both users with normal hearing and users with hearing loss will experience benefits of improved externalization and localization of sound sources associated with respective monaural signal transmitters when using the binaural hearing system thereby enjoying reproduced sound from externalized sound sources.

In the binaural hearing system, spatial cues are added to the electronic monaural signal utilizing binaural filters with directional transfer functions as explained in detail below:

Human beings detect and localize monaural signal transmitters in three-dimensional space by means of the human binaural sound localization capability.

The input to the hearing consists of two signals, namely the sound pressures at each of the eardrums, in the following termed the binaural sound signals. Thus, if sound pressures at the eardrums that would have been generated by a given spatial sound field are accurately reproduced at the eardrums, the human auditory system will not be able to distinguish the reproduced sound from the actual sound generated by the spatial sound field itself.

The transmission of a sound wave to the eardrums from a sound source positioned at a given direction and distance in relation to the left and right ears of the listener is described in terms of two transfer functions, one for the left eardrum and one for the right eardrum, that include any linear distortion, such as coloration, interaural time differences and interaural spectral differences. Such a set of two transfer functions, one for the left eardrum and one for the right eardrum, is called a Head Related Transfer Function (HRTF). Each transfer function of the HRTF is defined as the ratio between a sound pressure p generated by a plane wave at a specific point in or close to the appertaining ear canal ($p_L$ in the left ear canal and $p_R$ in the right ear canal) in relation to a reference. The reference traditionally chosen is the sound pressure $p_I$ that would have been generated by a plane wave at a position right in the middle of the head with the listener absent.

The HRTF contains all information relating to the sound transmission to the ears of the listener, including diffraction around the head, reflections from shoulders, reflections in the ear canal, etc., and therefore, the HRTF varies from individual to individual.

In the following, one of the transfer functions of the HRTF will also be termed the HRTF for convenience.

The HRTF changes with direction and distance of the sound source in relation to the ears of the listener. It is possible to measure the HRTF for any direction and distance and simulate the HRTF, e.g. electronically, e.g. by filters. If such filters are inserted in the signal path between a audio signal source, such as a microphone, and headphones used by a listener, the listener will achieve the perception that the sounds generated by the headphones originate from a sound source positioned at the distance and in the direction as defined by the transfer functions of the filters simulating the HRTF in question, because of the true reproduction of the sound pressures in the ears.

Binaural processing by the brain, when interpreting the spatially encoded information, results in several positive effects, namely better signal source segregation, direction of arrival (DOA) estimation, and depth/distance perception.

It is not fully known how the human auditory system extracts information about distance and direction to a sound source, but it is known that the human auditory system uses a number of cues in this determination. Among the cues are spectral cues, reverberation cues, interaural time differences (ITD), interaural phase differences (IPD) and interaural level differences (ILD).

The most important cues in binaural processing are the interaural time differences (ITD) and the interaural level differences (ILD). The ITD results from the difference in distance from the source to the two ears. This cue is primarily useful up till approximately 1.5 kHz and above this frequency the auditory system can no longer resolve the ITD cue.

The level difference is a result of diffraction and is determined by the relative position of the ears compared to the source. This cue is dominant above 2 kHz but the auditory system is equally sensitive to changes in ILD over the entire spectrum.

It has been argued that hearing impaired subjects benefit the most from the ITD cue since the hearing loss tends to be less severe in the lower frequencies.

A directional transfer function is an HRTF or an approximation to an HRTF that adds directional cues, such as spectral cues, reverberation cues, interaural time differences (ITD), interaural phase differences (IPD) and interaural level differences (ILD), etc., to an electronic monaural signal so that the user listening to a binaural sound signal based on the output signal of a binaural filter applying the directional transfer function to the electronic monaural signal perceives the sound to be emitted from a sound source residing in a direction defined by the directional transfer function.

For example, approximations to the individual HRTFs may be determined using a manikin, such as KEMAR. In this way, approximations of HRTFs may be provided that can be of sufficient accuracy for the user of the binaural hearing system to maintain sense of direction when using the binaural hearing system.

A binaural hearing system is provided with improved localization of a sound source emitting sound that is propagating as an acoustic wave to the binaural hearing system, wherein the sound is also converted to an electronic monaural signal that is transmitted wired or wirelessly to the binaural hearing system.

The electronic monaural signal may be correlated with the sound propagating as an acoustic wave to the binaural hearing system as received by microphones of the binaural hearing system in order to determine directional transfer functions from the respective sound source to each of the microphones, including the filter functions of the transmission paths from the sound source to each of the respective microphones.

At each ear of the user, a selected one of the determined directional transfer functions of microphones mounted at the ear in question, or a resulting directional transfer function determined from the determined directional transfer functions to microphones mounted at the ear in question, may then be used to filter the electronic monaural signal before conversion of the filtered signal into a signal that is transmitted to the ear at which the microphone in question is mounted so that the user will perceive the filtered signal to arrive from the DOA of the respective sound source.

For example, it is well-known that directional transfer functions of a microphone positioned at the entrance to an ear canal of a user are good approximations to the respective left ear part or right ear part of the corresponding HRTFs of the user.

The determined directional transfer functions may then be compared with HRTFs or approximate HRTFs to determine the HRTF or approximate HRTF that forms part of the determined directional transfer function and that HRTF or approximate HRTF may then be used to filter the electronic monaural signal before conversion of the filtered signal into a signal that is transmitted to the ear at which the microphone in question is mounted so that the user will perceive the filtered signal to arrive from the DOA of the sound source.

For example, sound propagation may be described by a linear wave equation with a linear relationship between the electronic monaural signal and each of the output signals.

For example, in the time domain for a time invariant system, the electronic monaural signal x(n) and each of the microphone output signals $y^k(n)$ fulfill the equation:

$$y^k(n)=g^k(n)*x(n)+v^k(n),$$

where (*) is the convolution operator, k is an index of the microphones, n is the sample index, $g^k$ is the impulse response of the filter function of the transmission paths from the sound source to the $k^{th}$ microphone, and $v^k$ is noise as received at the $k^{th}$ microphone. The impulse response of filter function $g^k(n)$ of the transmission paths from the respective sound source to the $k^{th}$ microphone includes room reverberations and the impulse response of the $k^{th}$ directional transfer function.

One way of determining the impulse response of the transfer functions $g^k(n)$ is to solve the following minimization problem:

$$\hat{g}^k(n) = \underset{g^k}{\arg\min} \sum_{k=1}^{N} \|y^k(n) - g^k(n) * x(n) + v^k(n)\|^p$$

wherein N is the total number of microphones, and p is an integer, e.g. p=2.

The minimization problem may also be solved for a set of selected microphones.

The minimization problem may also be solved in the frequency domain.

In a room with no, or insignificant, reverberations, the directional transfer function $G^k(f)$ with the impulse response $g^k(n)$ may be determined as the ratio between the electronic monaural signal in the frequency domain X(f) and the output signal of the $k^{th}$ microphone in the frequency domain $Y^k(f)$:

$$G^k(f) = \frac{Y^k(f)}{X(f)}$$

The impulse response $\hat{g}^k(n)$ of the transfer function $G^k(f)$ may then be used as the impulse response of the directional transfer function; or, the impulse response of the transfer function $\hat{g}^k(n)$ may be truncated to eliminate or suppress room reverberations and the truncated impulse response $\hat{g}^k(n)$ may be used as the impulse response of the directional transfer function.

Subsequently, at each ear of the user, a selected one of the determined directional transfer functions, $\hat{g}^k(n)$ in the time domain and $G^k(f)$ in the frequency domain, of microphones mounted at the ear in question, or a resulting directional transfer function determined from the determined directional transfer functions of microphones mounted at the ear in question, may then be used to filter the monaural signal before conversion of the filtered signal into a signal that is transmitted to the ear at which the microphone in question is mounted so that the user will perceive the filtered signal to arrive from the DOA of the sound source.

The determined directional transfer functions may also be compared with impulse responses of HRTFs or approximate HRTFs to determine the HRTF or approximate HRTF that forms part of the determined directional transfer function and that HRTF or approximate HRTF may then be used to filter the monaural signal before conversion of the filtered signal into a signal that is transmitted to the ear at which the microphone in question is mounted, so that the user will perceive the filtered signal to arrive from the DOA of the sound source.

Thus, a binaural hearing system is provided, comprising a binaural hearing device with a first housing adapted to be worn at a first ear of a user of the binaural hearing system and accommodating a first set of microphones for conversion of sound arriving at the first set of microphones into a first set of corresponding microphone output signals, a second housing adapted to be worn at a second ear of the user and accommodating a second set of microphones for conversion of sound arriving at the second set of microphones into a second set of corresponding microphone output signals, a first output transducer for conversion of a first transducer audio signal supplied to the first output transducer into a first auditory output signal that can be received by the human auditory system at the first ear of the user when wearing the binaural hearing device, a second output transducer for conversion of a second transducer audio signal supplied to the second output transducer into a second auditory output signal that can be received by the human auditory system at the second ear of the user when wearing the binaural hearing device, and an electronic monaural signal receiver that is adapted for receiving an electronic monaural signal emitted by a monaural signal transmitter and for decoding and outputting the electronic monaural signal, wherein the monaural signal transmitter has generated the electronic monaural signal by encoding sound that is emitted by the sound source that is located at a distance to the user, and wherein the sound emitted by the sound source propagates to the binaural hearing system so that at least a part of the first and second sets of microphone output signals correspond to the electronic monaural signal, and a DOA estimator that is adapted for correlating the first and second set of microphone output signals with the electronic monaural signal for provision of directional transfer functions of the first and second set of microphones, and a binaural filter that is adapted for filtering the electronic monaural signal with transfer functions based on the directional transfer functions, i.e. the direction of arrival, for provision of the first and second transducer audio signals to the first and second output transducers, respectively, whereby the user perceives to hear the converted monaural signal as arriving from the sound source.

The DOA estimator may be adapted for estimating the DOA of sound emitted by a sound source based on cross-correlating selected microphone output signals of the first set of microphone output signals with the electronic monaural signal for provision of a first set of filtered microphone output signals, and cross-correlating selected microphone output signals of the second set of microphone output signals with the electronic monaural signal for provision of a second set of filtered microphone output signals for enhancement of at least a part of the first and second sets of microphone output signals that correspond to the electronic monaural signal, and estimating the DOA based on the first and second sets of filtered microphone output signals.

The DOA estimator may be adapted for estimating the DOA of sound emitted by a sound source by providing a first set of filtered microphone output signals $F1_i(t)=Mic_i1(t)*Rm_n(t')$, and providing a second set of filtered microphone output signals $F2_j(t)=Mic_j2(t)*Rm_n(t')$, wherein $Mic1_i(t)$ is a microphone output signal of the first set of microphone output signals, wherein i is an index number of the microphone output signal of the first set of microphone output signals, $Mic_i2(t)$ is a microphone output signal of the second set of microphone output signals, wherein j is an index number of the microphone output signal of the second set of microphone output signals, Rm_n(t') is the received electronic monaural signal, wherein n is an index number of the monaural signal transmitter that has emitted the electronic monaural signal, t' is the time t or the reversed time T−t, T is an arbitrary constant added so that the filtering is causal, and the operator * is the convolution operator, for enhancement of at least a part of the first and second sets of microphone output signals that correspond to the received electronic monaural signal Rm_n(t'), and estimating the direction of arrival based on the first and second sets of filtered microphone output signals $F1_i(t)$, $F2_j(t)$.

Each of the first and second sets of filtered microphone output signals comprises at least one filtered microphone output signal, and each of the first and second sets of filtered microphone output signals may comprise a filtered microphone output signal from each of the microphones of the respective first and second sets of microphones.

Rapid head movements may be tracked with a head tracker, i.e. a device that is mounted in a fixed position with relation to the head of the user so that the head tracker can detect head movements of the user and output a tracking signal that is a function of head orientation and, possibly, head position of the user.

The binaural hearing system may comprise a head tracker outputting a tracking signal that may be used to adjust the DOA determined with the DOA estimator, whereby the delay from head movement to corresponding adjustment of the DOA may be lowered.

The head tracker may be accommodated in one of the first and second housings of the binaural hearing system; or, both the first and second housing may accommodate a head tracker.

The head tracker may be accommodated in a separate housing of the binaural hearing system, e.g., mounted to a headband of the binaural hearing system.

The head tracker may have an inertial measurement unit positioned for determining head yaw, and optionally head pitch, and optionally head roll, when the user wears the hearing device in its intended operational position on the user's head.

Head yaw, head pitch, and head roll may be determined utilizing a head coordinate system. The head coordinate system may be defined with its centre located at the centre of the user's head, which is defined as the midpoint of a line drawn between the respective centres of the eardrums of the left and right ears of the user.

The x-axis of the head coordinate system may then point ahead through a centre of the nose of the user, and the y-axis may point towards the left ear through the centre of the left eardrum), and the z-axis may point upwards.

Head yaw is the angle between the x-axis of the head coordinate system, i.e. the forward looking direction of the user, projected onto a horizontal plane at the location of the user, and a horizontal reference direction, such as Magnetic North or True North. Thus like azimuth of the DOA, head yaw is a horizontal angle and for a non-moving sound source a change in head yaw leads to the same change in azimuth of the corresponding DOA.

Head pitch is the angle between the x-axis of the head coordinate system and the horizontal plane.

Head roll is the angle between the y-axis and the horizontal plane.

The head tracker may have tri-axis MEMS gyros that provide information on head yaw, head pitch, and head roll in addition to tri-axis accelerometers that provide information on three dimensional displacement of the head of the user in a way well-known in the art.

Thus, with the head tracker, the user's current position and head orientation can be provided for processing in the binaural hearing system.

The head tracker may also have a magnetic compass in the form of a tri-axis magnetometer facilitating determination of head yaw with relation to the magnetic field of the earth, e.g. with relation to Magnetic North.

For example, when the head tracker has detected no, or insignificant, head movements during determination of the transfer functions of the binaural filter based on the electronic monaural signal as disclosed above, the determined transfer functions are used to filter the monaural signal and subsequently, when head movements are detected by the head tracker, the determined transfer functions are modified in accordance with the changed orientation of the head of the user as detected by the head tracker, e.g. the azimuth of the DOA is changed in accordance with the detected change of head yaw.

In other words, the DOA of the sound source in question may be determined based on the tracking signal output by the head tracker that is calibrated based on the electronic monaural signal whenever the head of the user is kept still.

Throughout the present disclosure, the words "adapt" and "configure" are used synonymously and may substitute each other.

A method is also provided of processing an electronic monaural signal in a binaural hearing system having a first set of microphones worn at a first ear of a user of the binaural hearing system and a second set of microphones worn at a second ear of the user and an electronic input for provision of an electronic monaural signal received at the electronic input, the method comprising correlating a first and second set of microphone output signals provided by the first and second set of microphones, respectively, with the electronic monaural signal for provision of directional transfer functions of the first and second set of microphones, and filtering the electronic monaural signal with transfer functions based on the directional transfer functions.

The method may comprise the steps of cross-correlating selected microphone output signals of the first set of microphone output signals with the electronic monaural signal for provision of a first set of filtered microphone output signals, and cross-correlating selected microphone output signals of the second set of microphone output signals with the electronic monaural signal for provision of a second set of filtered microphone output signals, wherein at least a part of the first and second sets of microphone output signals that corresponds to the electronic monaural signal has been enhanced in the first and second sets of filtered microphone output signals.

A method is also provided of processing an electronic monaural signal in a binaural hearing system having a first set of microphones worn at a first ear of a user of the binaural hearing system and a second set of microphones worn at a second ear of the user and an electronic input for provision of an electronic monaural signal received at the electronic input, the method comprising estimating a direction of arrival at the user of sound emitted by a sound source associated with the electronic monaural signal received at the electronic input by providing a first set of filtered microphone output signals $F1_i(t)=Mic_i1(t)*Rm_n(t')$, and providing a second set of filtered microphone output signals $F2_i(t)=Mic_i2(t)*Rm_n(t')$, wherein $Mic1_i(t)$ is a microphone output signal of the first set of microphone output signals, wherein i is an index number of the microphone output signal of the first set of microphone output signals, $Mic_j2(t)$ is a microphone output signal of the second set of microphone output signals, wherein j is an index number of the microphone output signal of the second set of microphone output signals, Rm_n(t') is the received electronic monaural signal, wherein n is an index number of the monaural signal transmitter that has emitted the electronic monaural signal, t' is the time t or the reversed time T−t, T is an arbitrary constant added so that the filtering is causal, and the operator * is the convolution operator, for enhancement of at least a part of the selected microphone output signals that correspond to the electronic monaural signal Rm_n(t'), and estimating the direction of arrival based on the first and second sets of filtered microphone output signals $F1_i(t)$, $F2_j(t)$, and filtering the electronic monaural signal with transfer functions based on the direction of arrival.

The methods may further comprise determination of an interaural time difference (ITD) between acoustic reception of sound from the sound source associated with the monaural signal transmitter emitting the electronic monaural signal, at the left ear and at the right ear of the user wearing the binaural hearing system based on the first and second sets of filtered microphone output signals.

The ITD may be determined by determining the time lag between a filtered microphone output signal provided by one of the correlating filters based on one output signal formed by the one or more microphones positioned at the left ear when the user wears the binaural hearing system with a filtered microphone output signal provided by another one of the correlating filters based on one output signal formed by the one or more microphones positioned at the right ear when the user wears the binaural hearing system at which the correlation between the two filtered microphone output signals has a maximum.

The determination may be performed utilizing cross-correlation of the two filtered microphone output signals; or, the sum of squared differences (SSD), etc.

The method may further comprise determining the time lag between filtered microphone output signals selected from at least one of the first and second set of filtered microphone output signals, and determining whether the monaural signal transmitter is located in front of the user or behind the user based on the cross-correlating.

The determination may be performed utilizing cross-correlation of the two filtered microphone output signals; or, the sum of squared differences (SSD), etc.

The binaural hearing system may comprise a head worn device, such as a headset, a headphone, an earphone, an ear defender, an earmuff, etc., e.g. of the following types: Ear-Hook, In-Ear, On-Ear, Over-the-Ear, Behind-the-Neck, Helmet, Headguard, etc., a binaural hearing aid with hearing aids of any type, such as Behind-The-Ear (BTE), Receiver-In-the-Ear (RIE), In-The-Ear (ITE), In-The-Canal (ITC), Completely-In-the-Canal (CIC), etc.

Various positioning of microphones and output transducers in the above-mentioned head worn devices are well-known in the art of head worn devices, The first and second sets of microphones may be sets of omni-directional microphones, e.g., omni-directional front and rear microphones for conversion of sound arriving at the microphones into respective microphone output signals that can, e.g. selectively, be used to form a directional characteristic as is well-known in the art of head worn devices, such as hearing aids.

For In-The-Ear (ITE), In-The-Canal (ITC), Completely-In-the-Canal (CIC), hearing devices, such as hearing aids, each of the housings may also accommodate the output transducer, e.g. a receiver for conversion of a transducer audio signal supplied to the receiver into sound propagating as an acoustic wave towards an eardrum of the user.

For Behind-The-Ear (BTE) hearing devices, such as hearing aids, adapted to be worn behind the pinna of the user, each of the housings also accommodates the output transducer, e.g. the receiver, and further has a sound tube connected to the housing for propagation of the sound output by the receiver through the sound tube to an earpiece positioned and retained in the ear canal of the user and having an output port for transmission of the sound to the eardrum of the user.

Receiver-In-the-Ear (RIE) hearing devices, such as hearing aids, have housings that area similar to the housings of the BTE hearing devices apart from the fact that the receiver has been moved to the earpiece and therefore the sound tube has been substituted by an audio signal transmission member that comprises electrical conductors for propagation of the transducer audio signal to the receiver positioned in the earpiece for emission of sound through an output port of the earpiece towards the eardrum of the user.

Some hearing devices with the earpiece also have one or more microphones that are accommodated in the earpiece.

The binaural hearing system may comprise a hearing prosthesis with an implantable device, such as a cochlear implant (CI), wherein the output transducer is an electrode array implanted in the cochlea for electronic stimulation of the cochlear nerve that carries auditory sensory information from the cochlea to the brain as is well-known in the art of cochlear implants.

The binaural hearing system may comprise a body worn device that is adapted or configured for communication with other parts of the binaural hearing system and for performing at least a part of the signal processing of the binaural hearing system, and may comprise a user interface, or part of a user interface, of the binaural hearing system.

The body worn device may be a hand-held device, such as a tablet PC, such as an IPAD, mini-IPAD, etc., a smartphone, such as an IPhone, an Android phone, a windows phone, etc., etc.

The one or more DOA estimators; or, parts of the one or more DOA estimators; and/or, the binaural filter; or, parts of the binaural filters; and/or other parts of the processing circuitry of the binaural hearing system may be included in the body worn device that is interconnected with other parts of the binaural hearing system.

The parts of the circuitry of the binaural hearing system included in the body worn device may benefit from the larger computing resources and power supply typically available in a body worn device as compared with the limited computing resources and power that may be available in the binaural hearing system, in particular when the binaural hearing system comprise a binaural hearing aid.

The body worn device may accommodate a user interface adapted for user control of at least part of the binaural hearing system.

The body worn device may function as a remote control of the binaural hearing system.

The body worn device may have an interface for connection with a Wide-Area-Network, such as the Internet.

The body worn device may access the Wide-Area-Network through a mobile telephone network, such as GSM, IS-95, UMTS, CDMA-2000, etc.

The binaural hearing system may comprise a data interface for transmission of control signals from the body worn device to other parts of the binaural hearing system.

The data interface may be a wired interface, e.g. a USB interface, or a wireless interface, such as a Bluetooth interface, e.g. a Bluetooth Low Energy interface.

The electronic monaural signal receiver may be a radio device that is adapted for reception of radio signals, e.g. for reception of streamed audio in general, such as streamed music and speech.

The electronic monaural signal receiver may be adapted to retrieve digital data from the received electronic monaural signal, including digital audio, possible transmitter identifiers, possible network control signals, etc., and forward the retrieved digital data to other parts of the binaural hearing system for processing, or for control of the processing.

The received electronic monaural signal may include signals from a plurality of monaural signal transmitters and thus, the received electronic monaural signal may form a plurality of signals forwarded to other parts of the binaural hearing system, such as DOA estimators disclosed below, e.g. one electronic monaural signal forwarded to one DOA estimator for each monaural signal transmitter.

The received electronic monaural signal may also contain data relating to the identity of the monaural signal transmitter. The electronic monaural signal receiver may be adapted to extract these data from the received electronic monaural signal so that the received electronic monaural signal can be separated into the plurality of electronic monaural signals, namely one for each monaural signal transmitter.

In order for the binaural hearing system to be capable of imparting sense of direction towards a sound source associated with a monaural signal transmitter to the respective electronic monaural signal, the binaural hearing system may comprise a DOA estimator that is adapted for estimating the DOA of sound from the sound source associated with the monaural signal transmitter in question based on cross-correlating each of the first and second sets of microphone output signals with the respective electronic monaural signal for provision of respective first and second sets of filtered microphone output signals for enhancement of the at least a part of the first and second sets of microphone output signals that correspond to the electronic monaural signal, and estimating the DOA based on the first and second sets of filtered microphone output signals.

The electronic monaural signal has a high signal-to-noise ratio because it is generated by the monaural signal transmitter without interfering noise; or with very little interfering noise.

With the binaural hearing system, spatial cues relating to a specific sound source associated with a specific monaural signal transmitter can be obtained even in very noisy sound environments and can also be obtained selectively in sound environments with a plurality of sound sources, each of which are associated with a respective monaural signal transmitter.

With the binaural hearing system, spatial cues relating to the specific sound source associated with the specific monaural signal transmitter are obtained by correlating output signals of the microphones of the binaural hearing system with the electronic monaural signal originating from the specific monaural signal transmitter in a correlating filter that outputs a filtered microphone output signal in which parts of the output signals that are not related to the electronic monaural signal of the specific monaural signal transmitter have been suppressed or eliminated, or in other words parts of the output signals of the microphones that correspond to the electronic monaural signal of the specific monaural signal transmitter, are enhanced.

The correlating filter may be a matched filter having an impulse response h(t) that is equal to the electronic monaural signal from the monaural signal transmitter of which it is desired to obtain spatial cues, possibly reversed in time.

Thus, in a sound environment with a plurality of sound sources associated with respective monaural signal transmitters generating electronic monaural signals, a selected one of the received electronic monaural signals may be denoted Rm_n(t), wherein Rm is an abbreviation of Received monaural, n is an index number of the monaural signal transmitter in question, and t is time. If it is desired to obtain spatial cues relating to the sound source associated with the monaural signal transmitter generating Rm_n(t), one or more output signals formed by the one or more microphones positioned at the left ear of the user and one or more output signals formed by the one or more microphones at the right ear of the user are filtered by respective correlating filters with the impulse response:

$$h(t)=Rm_n(-t);\ \text{or,}$$

$$h(t)=Rm_n(t).$$

In this way, parts of the output signals of the microphones that correspond to the selected one of the plurality of electronic monaural signals Rm_n(t) are enhanced in the filtered microphone output signals, and the estimation of the DOA of sound emitted by the sound source associated with the monaural signal transmitter from which the selected one of the received electronic monaural signals Rm_n(t) originates, is subsequently based on the filtered microphone output signals for selective DOA estimation and improved estimation accuracy due to the reduced influence of noise and other electronic monaural signals than the selected one of the electronic monaural signals.

Thus, each of the correlating filters performs the following filtering function:

$$F(t)=\mathrm{Mic}(t)*Rm_n(-t),\ \text{wherein}$$

F(t) is the filtered microphone output signal,

Mic(t) is one of the output signals formed by the one or more microphones, or formed by a combination of the one or more microphones, positioned at the left ear of the user or one of the output signals formed by the one or more microphones, or formed by a combination of the one or more microphones, at the right ear of the user, Rm_n(−t) is the selected time reversed electronic monaural signal, and the operator * is the convolution operator.

Alternatively, the correlating filter may also convolve the microphone output signal Mic(t) with Rm_n(t) without reversing time.

In the following, the filter operation of the correlating filter is denoted a cross-correlation of the microphone output signal Mic(t) with the selected one of the received electronic monaural signals Rm_n(t).

Thus, the output F(t) of the cross-correlation of the microphone output signal Mic(t) with the selected one of the received electronic monaural signals Rm_n(t) may be $$F(t)=\mathrm{Mic}(t)*Rm_n(-t);\ \text{or,}$$

$$F(t)=\mathrm{Mic}(t)*Rm_n(t).$$

The time reversed electronic monaural signal may be time shifted with an arbitrary constant T to ensure that the correlating filter is a causal filter so that the output F(t) of the cross-correlation of the microphone output signal Mic(t) with the selected one of the received electronic monaural signals Rm_n(t) may be $$F(t)=\mathrm{Mic}(t)*Rm_n(T-t).$$

The binaural hearing system may receive a single electronic monaural signal and the method of estimating the DOA may be performed for the single electronic monaural signal.

The binaural hearing system may receive a plurality of electronic monaural signals and the method of estimating the DOA may be performed for a selected electronic monaural signal of the plurality of electronic monaural signals; or for a set of selected electronic monaural signals of the plurality of electronic monaural signals; or for all of the electronic monaural signals of the plurality of electronic monaural signals.

An interaural time difference (ITD) between acoustic reception of sound of the sound source associated with the monaural signal transmitter from which the selected one of the electronic monaural signals originates, at the left ear and the right ear of the user wearing the binaural hearing system may be determined based on the filtered microphone output signals provided by the correlating filters, i.e. the filtered output signals of microphones positioned at the left ear and the right ear, respectively, when the user wears the binaural hearing system.

The ITD may be determined by cross-correlating a filtered microphone output signal provided by one of the correlating filters based on one output signal formed by the one or more microphones positioned at the left ear when the user wears the binaural hearing system with a filtered microphone output signal provided by another one of the correlating filters based on one output signal formed by the one or more microphones positioned at the right ear when the user wears the binaural hearing system.

Cross-correlating may be performed for a plurality of filtered microphone output signals and the results may be added to form a resultant cross-correlation output.

The ITD may then be determined as the time lag $\tau_n$ at which the cross-correlation output, possibly, the resultant cross-correlation output, has a maximum.

The determined ITD may be applied to the electronic monaural signal in question, i.e. the electronic monaural signal may be delayed by the determined ITD and provided to one of the ears while the electronic monaural signal is provided to the other ear without delay, wherein the ear that is presented with the delayed electronic monaural signal is selected in correspondence with the ITD determination. In this way, some sense of direction is conveyed to the user.

A corresponding interaural level difference ILD may be calculated from the ITD, e.g. based on the different lengths of the propagation paths to the ears of the user and/or head shadow and diffraction effects, and the ILD may be applied to the electronic monaural signal in question, i.e. the electronic monaural signal may be attenuated the determined ILD and provided to one of the ears while the electronic monaural signal is provided to the other ear without attenuation, wherein the ear that is presented with the attenuated electronic monaural signal is selected in correspondence with the ILD determination. In this way, the sense of direction conveyed to the user is improved.

There is no unique mapping of the determined ITD to the DOA, e.g. the azimuth $\phi$. For example, a sound source in a specific position behind the user and another sound source in a corresponding position in front of the user may result in the same ITD.

In order to determine whether a sound source associated with a monaural signal transmitter is located in front of or behind the user, filtered microphone output signals of differently positioned microphones positioned at the same ear of the user may be cross-correlated.

Cross-correlating may be performed for a plurality of filtered microphone output signals and the results may be added to form a resultant cross-correlation output.

The time lag $\tau_{2n}$ at which the cross-correlation, e.g. the resultant cross-correlation, has a maximum may then determined. The sign of $\tau_{2n}$ determines whether the sound source n is located in front of the user or behind the user.

Based on $\tau_{2n}$, and possibly the DOA of the sound source associated with the monaural signal transmitter from which the electronic monaural signal originates may be determined, e.g. by table look-up.

Based on the estimated DOA, e.g. azimuth $\phi$, a corresponding binaural filter may be selected that has a directional transfer function corresponding to the estimated DOA and that is adapted to output signals based on the electronic monaural signal and intended for the right ear and left ear of the user, wherein the output signals are phase shifted with a phase shift with relation to each other in order to introduce the ITD based on and corresponding to the estimated DOA, whereby the perceived position of the sound source associated with the corresponding monaural signal transmitter is shifted outside the head and laterally with relation to the orientation of the head of the user of the binaural hearing aid system.

Alternatively, or additionally, the binaural filter may be adapted to output signals based on the electronic monaural signal and intended for the right ear and left ear, respectively, of the user, wherein the output signals are equal to the electronic monaural signal multiplied with a right gain and a left gain, respectively; in order to obtain an ILD based on and corresponding to the estimated DOA, whereby the sense of direction perceived by the user is enhanced.

For example, the binaural filter may have a selected HRTF with a directional transfer function that corresponds to the estimated DOA so that the user perceives the received electronic monaural signal to be emitted by the sound source at its current position with relation to the user.

The HRTF may be selected from a set of HRTFs that have been individually determined for the user; or, the HRTF may be selected form a set of approximate HRTFs, e.g. as determined with a KEMAR head, or otherwise as an average of HRTFs for a population of humans.

The selected HRTF for a specific DOA may be calculated from other HRTFs for other DOAs, e.g. by interpolation.

HRTFs may be selected for a plurality of electronic monaural signals originating from different monaural signal transmitters, and the filtered microphone output signals for the left ear and the right ear, respectively, may be added, and the added filtered microphone output signals may be provided to the left ear and the right ear, respectively, whereby the user perceives to hear each of the electronic monaural signals from the respective directions towards the different sound sources associated with respective monaural signal transmitters from which the respective electronic monaural signals originate.

EXAMPLE

In the following, the method of estimating the DOA to an $n^{th}$ sound source associated with an $n^{th}$ monaural signal transmitter of a plurality of N monaural signal transmitters residing in the sound environment of the user is explained in more detail. The $n^{th}$ sound source may be a speaking human using a spouse microphone for wireless emission of the electronic monaural signal containing the speech.

The binaural hearing system has first and second housings to be worn at the left ear and the right ear, respectively, of the user. Each of the housings accommodates two omnidirectional microphones, namely a front microphone and a rear microphone that can be used to form a directional microphone array at each ear of the user as is well-known in the art of hearing aids.

Thus, in this example the first housing is adapted to be worn at the right ear of the user and accommodates the first set of microphones comprising the right ear front microphone with index number I=1 and the right ear rear microphone with index number I=2 and providing the right ear front microphone output signal $Mic1_1(t)$ and the right ear rear microphone output signal $Mic1_2(t)$, respectively. Correspondingly, the second housing is adapted to be worn at the left ear of the user and accommodates the second set of microphones comprising the left ear front microphone with index number j=1 and the left ear rear microphone with index number j=2 and providing the left ear front microphone output signal $Mic2_1(t)$ and the left ear rear microphone output signal $Mic2_2(t)$, respectively.

In a first step of the method, the microphone signals are correlated with the $n^{th}$ electronic monaural signal Rm_n(t) in order to enhance the sound emitted by the $n^{th}$ monaural signal transmitter in the microphone signals. Thus, the following correlations are performed:

Left ear:

$$EF_LF(t)=\text{Hi}_LF(t)*Rm_n(-t)$$

$$EF_LR(t)=\text{Hi}_LR(t)*Rm_n(-t)$$

Right ear:

$$EF_RF(t)=\text{Hi}_RF(t)*Rm_n(-t)$$

$$EF_RR(t)=\text{Hi}_RR(t)*Rm_n(-t)$$

wherein

Hi_LF(t) is the output signal of the front microphone at the left ear, i.e. $Mic2_1(t)$, and EF_LF(t) is the corresponding output signal of the correlating filter established for the front microphone at the left ear;

Hi_LR is the output signal of the rear microphone at the left ear, i.e. $Mic2_2(t)$, and EF_LR(t) is the corresponding output signal of the correlating filter established for the rear microphone at the left ear;

Hi_RF is the output signal of the front microphone at the right ear, i.e. $Mic1_1(t)$, and EF_RF(t) is the corresponding output signal of the correlating filter established for the front microphone at the right ear;

Hi_RR is the output signal of the rear microphone at the right ear, i.e. $Mic1_1(t)$, and EF_RR(t) is the corresponding output signal of the correlating filter established for the rear microphone at the right ear;

* is the convolution operator.

Alternatively, the cross-correlation can also be performed without time reversing the electronic monaural signal Rm_n.

In a next step of the method, the ITD is determined by cross-correlating enhanced signals of microphones worn at different ears, i.e. cross-correlating EF_LF with EF_RF and cross-correlating EF_LR with EF_RR, and adding the results of the cross-correlations to form S(t):

$$S(t)=EF_LF(t)*EF_RF(-t)+EF_LR(t)*EF_RR(-t)$$

Then, the time lag $\tau_n$ where S(t) has maximum is determined.

$\tau_n$ is the ITD of the acoustic sound from the $n^{th}$ monaural signal transmitter when received at the microphones worn at the left and right ears, respectively, of the user.

In a next step of the method, it is determined whether the $n^{th}$ sound source associated with the $n^{th}$ monaural signal transmitter resides in front of the user or behind the user by cross-correlating the enhanced signals of front and rear microphones of the same ear, i.e. cross-correlating EF_LF with EF_LR and cross-correlating EF_RF with EF_RR, and adding the results of the cross-correlations to form U(t):

$$U(t)=EF_LF(t)*EF_LR(-t)+EF_RF(t)*EF_RR(-t)$$

Then, the time lag $\tau_{2n}$ where U(t) has maximum is determined.

The sign of $\tau_{2n}$ determines if the $n^{th}$ sound source associated with the $n^{th}$ monaural signal transmitter is located in front of, or behind, the user.

Based on $\tau_n$ and $\tau_{2n}$ and a table look-up, the azimuth $\phi_n$ of the DOA of the $n^{th}$ sound source is determined.

Using a table look-up (using e.g. a KEMAR HRTF database) the corresponding HRTF can be selected: HRTF_L($\phi_n$, t), HRTF_R($\phi_n$, t), wherein HRTF_L is the left ear part of the HRTF and HRTF_R is the right ear part of the HRTF.

The information on the DOA is imparted onto the $n^{th}$ electronic monaural signal Rm_n(t) from the $n^{th}$ monaural signal transmitter by filtering the $n^{th}$ electronic monaural signal Rm_n(t) with the selected HRTF:

$$Yn_L(t)=\text{HRTF}_L(\phi_n,t)*Rm_n(t)$$

$$Yn_R(t)=\text{HRTF}_R(\phi_n,t)*Rm_n(t)$$

and providing Yn_L(t) to the left ear of the user and Yn_R(t) to the right ear of the user.

In this way, the user perceives to listen to the $n^{th}$ electronic monaural signal Rm_n(t) as if the signal is arriving from the DOA of the $n^{th}$ sound source.

In this example, this is repeated for all N sound sources and associated monaural signal transmitters residing in the sound environment of the user and transmitting respective electronic monaural signals to the binaural hearing system.

For each monaural signal transmitter of the N monaural signal transmitters, the microphone signals are correlated with the respective $n^{th}$ electronic monaural signal Rm_n(t) in order to enhance the sound emitted by the $n^{th}$ monaural signal transmitter in the microphone signals, and the respective azimuth $\phi_n$ of the DOA of the $n^{th}$ sound source is determined and the corresponding $n^{th}$ HRTF is selected for filtering the respective $n^{th}$ electronic monaural signal Rm_n (t) in order to impart spatial cues corresponding to the respective azimuth $\phi_n$ onto the $n^{th}$ electronic monaural signal Rm_n(t).

Finally, the resulting signals are added to form Y_L(t) and Y_R(t) provided to the left and right ears, respectively, of the user:

$$Y_L(t)=Y1_L(t)+Y2_L(t)+\ldots+Yn_L(t)+\ldots+YN_L(t)$$

$$Y_R(t)=Y1_R(t)+Y2_R(t)+\ldots+Yn_R(t)+\ldots+YN_R(t).$$

In this way, the user perceives to listen to each of the N electronic monaural signals Rm_n(t) as if each of the signals is arriving from the DOA of the respective $n^{th}$ sound source. Thus, the user will be able to separate individual sound sources associated with respective monaural signal transmitters and, e.g. focus his or her listening on a selected sound source. Further, the user's ability to understand speech is improved due to the externalization of the electronic monaural signals, and the user's ability to understand speech from one sound source of a plurality of simultaneously speaking sound sources is improved.

The binaural hearing system may have an antenna and a wireless receiver connected to the antenna for reception of one or more electronic monaural signals encoded for wireless transmission to the binaural hearing system. The wireless receiver is adapted to retrieve the one or more electronic monaural signals from the received encoded signal. The received encoded signal may contain the one or more electronic monaural signals in digitized form possibly together with identifiers of the electronic monaural signal transmitter so that electronic monaural signals from different monaural signal transmitters can be separated and each of the electronic monaural signals can be provided to a respective separate DOA estimator.

Thus, the binaural hearing system may comprise a plurality of DOA estimators, one for each monaural signal transmitter in the sound environment.

Each of the DOA estimators may be adapted for cross-correlating microphone signals selected from at least one of the first and second set of microphone output signals and for determining whether the sound source associated with the monaural signal transmitter is located in front of the user or behind the user based on the cross-correlating.

Each of the DOA estimators may be adapted for determining a first time-lag at which a result of the cross-correlating has a maximum, and for determining whether the sound source associated with the monaural signal transmitter is located in front of the user or behind the user based on the sign of the first time-lag.

Each of the DOA estimators may be adapted for cross-correlating microphone output signals selected from the first set of microphone output signals with microphone output signals selected from the second set of microphone output signals, and for estimating the DOA based on the cross-correlating.

Each of the DOA estimators may be adapted for determining a second time-lag at which a result of the cross-correlating of microphone output signals selected from the first set of microphone output signals with microphone output signals selected from the second set of microphone output signals has a maximum, and for determining the interaural time difference as the second time-lag.

Each of the DOA estimators may be adapted for determining the DOA based on the interaural time difference.

Each of the DOA estimators may be adapted for determining the DOA based on the interaural time difference and the sign of the first time-lag.

The binaural hearing system may comprise a binaural filter for filtering the electronic monaural signal and adapted to output first and second output signals each of which is selected from the group of signals consisting of:

the electronic monaural signal phase shifted with a phase shift based on the estimated DOA, the electronic monaural signal multiplied with a gain based on the estimated DOA, and the electronic monaural signal multiplied with a gain and phase shifted with a phase shift, wherein the gain and phase shift are based on the estimated DOA, and wherein the first and second output signals are supplied to the first and second output transducers constituting the first and second transducer audio signals, respectively, whereby the user perceives to hear the converted electronic monaural signal as arriving from the estimated DOA.

The binaural filter may be adapted for providing first and second output signals that are equal to the electronic monaural signal, but phase shifted by different respective amounts and thereby phase shifted with relation to each other with an amount corresponding to the ITD.

The binaural filter may alternatively or additionally be adapted for providing output signals that are equal to the input signal, but multiplied with different respective gains to obtain an ILD that corresponds to the estimated DOA.

The binaural filter may have a directional transfer function that is equal to an HRTF that has been determined individually for the user of the binaural hearing system for the estimated DOA or an HRTF that approximates an individually determined HRTF and that is determined for e.g. an artificial head, such as a KEMAR head. In this way, an approximation to the individual HRTF is provided that can be of sufficient accuracy for the user of the binaural hearing system to maintain sense of direction when wearing the binaural hearing system.

The binaural filter may be adapted for individually processing the electronic monaural signal in a plurality of frequency channels.

The binaural hearing system may have a plurality of binaural filters with different directional transfer functions applied to different electronic monaural signals corresponding to the respective estimated DOAs.

The first and second hearing devices may be hearing aids comprising a hearing loss processor that is adapted for compensation of a hearing loss of the user.

The binaural hearing system may comprise a binaural hearing aid comprising multi-channel first and/or second hearing aids in which the signals are divided into a plurality of frequency channels for individual processing of at least some of the signals in each of the frequency channels.

The plurality of frequency channels may include warped frequency channels, for example all of the frequency channels may be warped frequency channels.

The binaural hearing aid may additionally provide circuitry used in accordance with other conventional methods of hearing loss compensation so that the new circuitry or other conventional circuitry can be selected for operation as appropriate in different types of sound environment. The different sound environments may include speech, babble speech, restaurant clatter, music, traffic noise, etc.

The binaural hearing aid may for example comprise a Digital Signal Processor (DSP), the processing of which is controlled by selectable signal processing algorithms, each of which having various parameters for adjustment of the actual signal processing performed. The gains in each of the frequency channels of a multi-channel hearing aid are examples of such parameters.

One of the selectable signal processing algorithms operates in accordance with the method of imparting spatial cues to one or more electronic monaural signals explained above.

For example, various algorithms may be provided for conventional noise suppression, i.e. attenuation of undesired signals and amplification of desired signals.

Microphone output signals obtained from different sound environments may possess very different characteristics, e.g. average and maximum sound pressure levels (SPLs) and/or frequency content. Therefore, each type of sound environment may be associated with a particular program wherein a particular setting of algorithm parameters of a signal processing algorithm provides processed sound of optimum signal quality in a specific sound environment. A set of such parameters may typically include parameters related to broadband gain, corner frequencies or slopes of frequency-selective filter algorithms and parameters controlling e.g. knee-points and compression ratios of Automatic Gain Control (AGC) algorithms.

Signal processing characteristics of each of the algorithms may be determined during an initial fitting session in a dispensers office and programmed into the binaural hearing aid in a non-volatile memory area.

The binaural hearing aid may have a user interface, e.g. buttons, toggle switches, etc., of the hearing aid housings, or a remote control, so that the user of the binaural hearing aid can select one of the available signal processing algorithms to obtain the desired hearing loss compensation in the sound environment in question.

Typically, analogue signals are made suitable for digital signal processing by conversion into corresponding digital signals in an analogue-to-digital converter whereby the amplitude of the analogue signal is represented by a binary number. In this way, a discrete-time and discrete-amplitude digital signal in the form of a sequence of digital values represents the continuous-time and continuous-amplitude analogue signal.

Throughout the present disclosure, one signal is said to represent another signal when the one signal is a function of the other signal, for example the one signal may be formed by analogue-to-digital conversion, or digital-to-analogue conversion of the other signal; or, the one signal may be formed by conversion of an acoustic signal into an electronic signal or vice versa; or the one signal may be formed by analogue or digital filtering or mixing of the other signal; or the one signal may be formed by transformation, such as frequency transformation, etc., of the other signal; etc.

Further, signals that are processed by specific circuitry, e.g. in a processor, may be identified by a name that may be used to identify any analogue or digital signal forming part of the signal path of the signal in question from its input of the circuitry in question to its output of the circuitry. For example an output signal of a microphone, i.e. the microphone audio signal, may be used to identify any analogue or digital signal forming part of the signal path from the output of the microphone to its input to the receiver, including any processed microphone audio signals.

The binaural hearing system may additionally provide circuitry used in accordance with other conventional methods of, e.g. hearing loss compensation, noise suppression, etc., so that the new circuitry or other conventional circuitry can be selected for operation as appropriate in different types of sound environment. The different sound environments may include speech, babble speech, restaurant clatter, music, traffic noise, etc.

The binaural hearing system may for example comprise a Digital Signal Processor (DSP), the processing of which is controlled by selectable signal processing algorithms, each of which having various parameters for adjustment of the actual signal processing performed. The gains in each of the frequency channels of a multi-channel hearing system are examples of such parameters.

One of the selectable signal processing algorithms operates in accordance with the method disclosed herein.

For example, various algorithms may be provided for conventional noise suppression, i.e. attenuation of undesired signals and amplification of desired signals.

Signal processing in the binaural hearing system may be performed by dedicated hardware or may be performed in a signal processor, or performed in a combination of dedicated hardware and one or more signal processors.

As used herein, the terms "processor", "signal processor", "controller", "system", etc., are intended to refer to CPU-related entities, either hardware, a combination of hardware and software, software, or software in execution. The term processor may also refer to any integrated circuit that includes some hardware, which may or may not be a CPU-related entity. For example, in some embodiments, a processor may include a filter.

For example, a "processor", "signal processor", "controller", "system", etc., may be, but is not limited to being, a process running on a processor, a processor, an object, an executable file, a thread of execution, and/or a program.

By way of illustration, the terms "processor", "signal processor", "controller", "system", etc., designate both an application running on a processor and a hardware processor. One or more "processors", "signal processors", "controllers", "systems" and the like, or any combination hereof, may reside within a process and/or thread of execution, and one or more "processors", "signal processors", "controllers", "systems", etc., or any combination hereof, may be localized on one hardware processor, possibly in combination with other hardware circuitry, and/or distributed between two or more hardware processors, possibly in combination with other hardware circuitry.

Also, a processor (or similar terms) may be any component or any combination of components that is capable of performing signal processing. For examples, the signal processor may be an ASIC processor, a FPGA processor, a general purpose processor, a microprocessor, a circuit component, or an integrated circuit.

A binaural hearing system includes: a binaural hearing device having a first housing configured to be worn at a first ear of a user of the binaural hearing system, the first housing accommodating a first set of microphones that is configured to provide a first set of microphone output signals, a second housing configured to be worn at a second ear of the user, the second housing accommodating a second set of microphones that is configured to provide a second set of microphone output signals, a first output transducer configured to convert a first transducer audio signal into a first auditory output signal for reception by an auditory system of the user when the user wears the first housing at the first ear, a second output transducer configured to convert a second transducer audio signal into a second auditory output signal for reception by the human auditory system when the user wears the second housing at the second ear; an electronic monaural signal receiver configured to receive an electronic monaural signal provided by a monaural signal transmitter, wherein the electronic monaural signal is based on sound emitted by a sound source that is located at a distance to the user; a direction of arrival estimator configured to correlate the first set and the second set of microphone output signals with the electronic monaural signal for provision of directional transfer functions for the first set and the second set of microphones; and a binaural filter configured to process the electronic monaural signal with transfer function(s) based on the directional transfer function(s) for provision of the first and second transducer audio signals to the first and second output transducers, respectively, whereby the electronic monaural signal is perceivable by the user as arriving from the sound source.

Optionally, the binaural hearing system is configured to receive the sound emitted by the sound source, so that at least a part of the first and second sets of microphone output signals corresponds to the electronic monaural signal.

Optionally, the direction of arrival estimator is configured to estimate a direction of arrival of the sound by: cross-correlating microphone output signal(s) from the first set of microphone output signals with the electronic monaural signal for provision of a first set of filtered microphone output signal(s), and cross-correlating microphone output signal(s) from the second set of microphone output signals with the electronic monaural signal for provision of a second set of filtered microphone output signal(s), and estimating the direction of arrival based on the first set of the filtered microphone output signal(s) and the second set of the filtered microphone output signal(s).

Optionally, the direction of arrival estimator is configured to determine whether the sound source is located in front of the user or behind the user.

Optionally, the direction of arrival estimator is configured to perform a cross-correlation based at least in part on microphone output signal(s) from the first set of microphone output signals and/or microphone output signal(s) from the second set of microphone output signals, and to determine a first time-lag at which a result of the cross-correlation has a maximum; and wherein the direction of arrival estimator is configured to determine whether the sound source is located in front of the user or behind the user based on a sign of the first time-lag.

Optionally, the direction of arrival estimator is configured to estimate a direction of arrival of the sound based on an interaural time difference and the sign of the first time-lag.

Optionally, the direction of arrival estimator is configured to determine a second time-lag at which a result of a cross-correlation of microphone output signal(s) from the first set of microphone output signals with microphone output signal(s) from the second set of microphone output signals has a maximum; and wherein the interaural time difference is the second time-lag.

Optionally, the direction of arrival estimator is configured to cross-correlate microphone output signal(s) from the first set of microphone output signals with microphone output signal(s) from the second set of microphone output signals to obtain an output, and to estimate a direction of arrival based on the output.

Optionally, the direction of arrival estimator is configured to estimate a direction of arrival based on an interaural time difference.

Optionally, the first and second transducer audio signals provisioned by the binaural filter are: phase shifted with relation to each other based on an estimated direction of arrival of the sound, and/or amplified with a mutual gain difference based on the estimated direction of arrival of the sound.

Optionally, the directional transfer function(s) corresponds with a Head Related Transfer Function.

Optionally, the binaural filter is configured to process the electronic monaural signal in a plurality of frequency channels.

Optionally, the binaural hearing system further includes a head tracker configured to be mounted at a head of the user for provision of a tracking signal containing information regarding a head movement of the user.

Optionally, the binaural hearing system further includes a hearing loss processor that is configured to compensate for a hearing loss of the user.

A method of processing an electronic monaural signal in a binaural hearing system having a first set of microphones worn at a first ear of a user of the binaural hearing system, and a second set of microphones worn at a second ear of the user, includes: correlating (1) a first set of microphone output signals provided by the first set of microphones and a second set of microphone output signals provided by the second set of microphones, respectively, with (2) the electronic monaural signal, for provision of directional transfer function(s) for the first and second set of microphones; and processing the electronic monaural signal with transfer function(s) based on the directional transfer function(s).

Optionally, the method further includes cross-correlating (1) microphone output signal(s) from the first set of microphone output signals and microphone output signal(s) from the second set of microphone output signals, respectively, with (2) the electronic monaural signal, for provision of first and second sets of filtered microphone output signals, respectively.

Optionally, in the first set of filtered microphone output signals, at least a part of the first set of microphone output signals corresponding to the electronic monaural signal has been enhanced; and wherein in the second set of filtered microphone output signals, at least a part of the second set of microphone output signals corresponding to the electronic monaural signal has been enhanced.

Optionally, the method further includes determining whether a sound source associated with the electronic monaural signal is located in front of the user or behind the user.

DESCRIPTION OF THE FIGURES

In the following, embodiments are explained in more detail with reference to the drawing, wherein.

DETAILED DESCRIPTION

Figure 1:
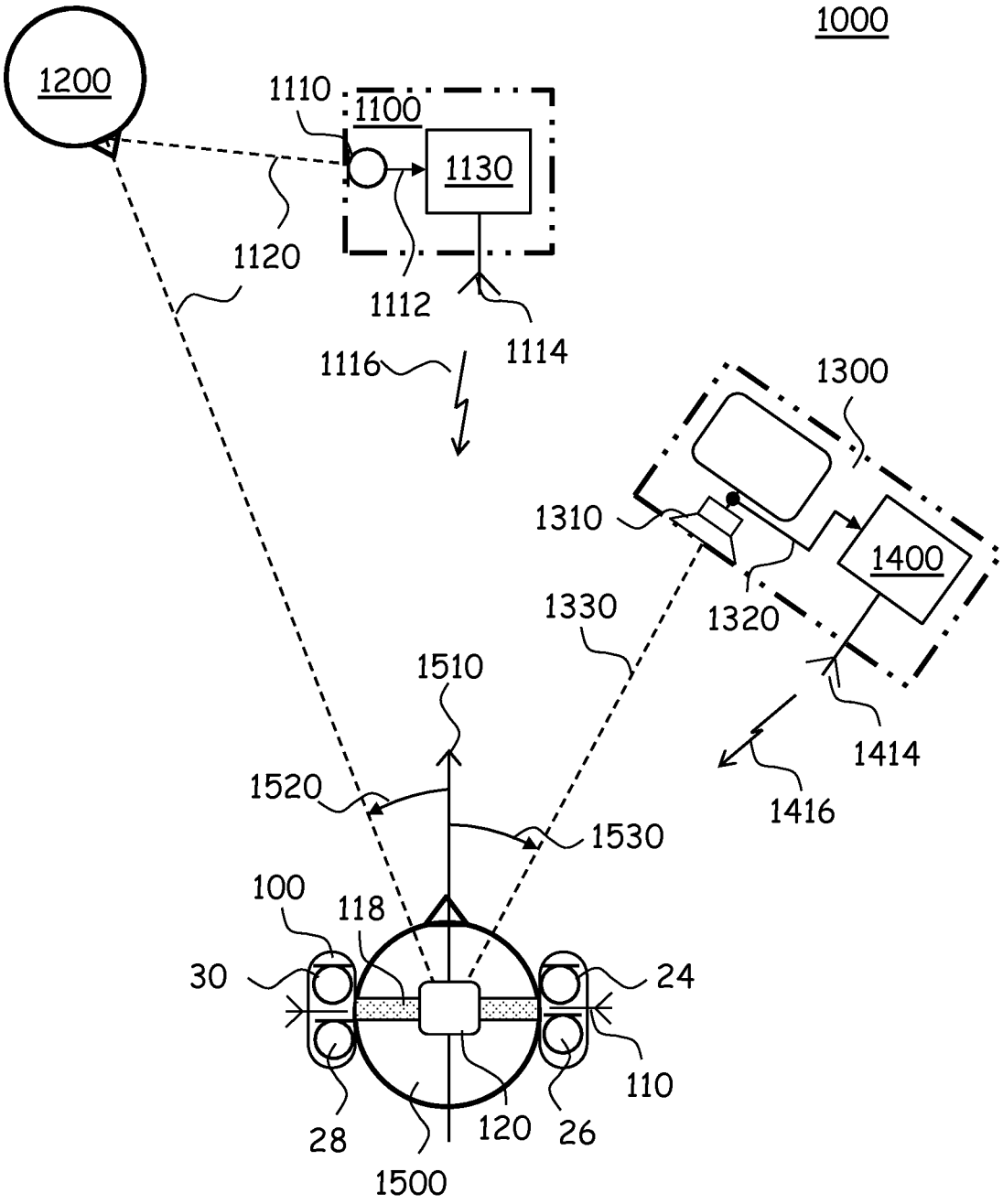
FIG. 1 shows an exemplary sound environment in which the binaural hearing system may be advantageously utilized.

Various embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The new method and binaural hearing system will now be described more fully hereinafter with reference to the accompanying drawings, in which various examples of the new binaural hearing aid system are shown. The new method and binaural hearing aid system may, however, be embodied in different forms and should not be construed as limited to the examples set forth herein.

FIG. 1 shows schematically an example of a binaural hearing system 100 according to the appended set of claims in a sound environment 1000 with two exemplary monaural signal transmitters of the first and second types, namely a spouse microphone 1100 worn by a human speaker 1200 and a streaming unit 1400 of a TV 1300.

The illustrated first type of monaural signal transmitters, i.e. the spouse microphone 1100, is a body-worn device, typically attached to the clothing with a mounting clip or hanging around the neck using a lanyard. The spouse microphone 1100 is intended to be worn with a short distance to the mouth of the human speaker 1200 wearing the spouse microphone 1100.

The spouse microphone 1100 has a microphone 1110 for reception of speech spoken by the human speaker 1200 and a streaming unit 1130 for receiving an output signal 1112 from the microphone 1110 and for conversion of the output signal 1112 into an electronic monaural signal in the form of digital audio and for encoding the digital audio for wireless transmission 1116 to the binaural hearing system 100 via the antenna 1114 emitting radio waves 1116.

The binaural hearing system 100 is adapted for reproducing the speech to its user 1500 based on the electronic monaural signal as received and decoded by a wireless receiver (not shown) of the binaural hearing system 100. The speech is also propagating as an acoustic wave 1120 towards the user 1500 and the binaural hearing system 100.

The propagation paths of the acoustic wave 1120 towards the user 1500 and towards the spouse microphone 1100 are indicated by dashed lines.

The illustrated second type of monaural signal transmitters, i.e. the TV 1300, has one or more loudspeakers 1310 that convert a source signal 1320 to sound that propagates as an acoustic wave 1330 towards the binaural hearing system 100 and thus, the monaural signal transmitter of this type also comprises the sound source, namely the loudspeaker 1310. The monaural signal transmitter 1300 of this type generates the electronic monaural signal based on the same source signal 1320 that is converted into the sound that propagates as an acoustic wave 1330 towards the binaural hearing system 100.

The TV 1300 also has a streaming unit 1400 for conversion of the source signal 1320 into an electronic monaural signal in the form of digital audio and for encoding the digital audio for wireless transmission to the binaural hearing system 100 via the antenna 1414 emitting radio waves 1416. The binaural hearing system 100 is adapted for reproducing the source signal 1320 to its user 1500 based on the electronic monaural signal as received and decoded by the wireless receiver (not shown) of the binaural hearing system 100.

The forward looking direction of the user 1500 is indicated by arrow 1510. The forward looking direction 1510 is defined by a virtual line drawn through the centre of the user's head and through a centre of the nose of the user 1500. The DOA of the acoustic wave 1120 propagating from the human 1200 to the user 1500 is indicated by curved arrow 1520.

The angle indicated by curved arrow 1520 is the azimuth $\phi$ of the DOA. Azimuth is the perceived angle $\phi$ of direction towards the monaural signal transmitter 1130, 1400 projected onto the horizontal plane with reference to the forward looking direction 1510 of the user 1500. The forward looking direction is defined by a virtual line drawn through the centre of the user's head and through a centre of the nose of the user 1500. Thus, a monaural signal transmitter located in the forward looking direction of the user has an azimuth value of $\phi=0°$, and a monaural signal transmitter located directly in the opposite direction has an azimuth value of $\phi=180°$. A monaural signal transmitter located in the left side of a vertical plane perpendicular to the forward looking direction of the user 1500 has an azimuth value of $\phi=-90°$, while a monaural signal transmitter located in the right side of the vertical plane perpendicular to the forward looking direction of the user 1500 has an azimuth value of $\phi=+90°$.

In FIG. 1, the sound environment 1000 is shown from above so that the plane of the paper is the horizontal plane.

The azimuth of the DOA of the acoustic wave 1330 propagating from the TV 1300 to the user 1500 is indicated by curved arrow 1530.

The binaural hearing system 100 is capable of adding spatial cues to the respective electronic monaural signals as received and decoded by the wireless receiver (not shown) of the binaural hearing system 100. The added spatial cues correspond to the DOA of sound that has propagated as an acoustic wave 1120, 1330 to the binaural hearing system 100, wherein the sound is also reproduced in the binaural hearing system 100 based on the received electronic monaural signals.

In the binaural hearing system 100, electronic monaural signals originating from different monaural signal transmitters 1130, 1400 are presented to the ears of the user 1500 in such a way that the user 1500 perceives the respective sound sources 1200, 1300 to be positioned in their current respective DOAs in the sound environment 1000 of the user 1500.

In this way, the human's auditory system's binaural signal processing is utilized to improve the user 1500's capability of separating signals from different monaural signal transmitters 1130, 1300 and of focussing his or her attention and listening to a desired one of the monaural signal transmitters 1130, 1300, or simultaneously listen to and understand more than one of the monaural signal transmitters 1130, 1300.

Both users with normal hearing and users with hearing loss will experience benefits of improved externalization and localization of sound sources when using the binaural hearing system 100 thereby enjoying reproduced sound from externalized sound sources.

The illustrated binaural hearing system 100 comprises a head tracker 120. The head tracker 120 is accommodated in a separate housing that is mounted to the headband 118 of the binaural hearing system 100 so that the head tracker 120 can detect head movements of the user 1500 and output a tracking signal that is a function of head orientation and head displacement of the user 1500.

In order to lower the delay from head movement to corresponding adjustment of the otherwise determined DOA, the tracking signal is used to adjust the DOA.

The head tracker 120 has an inertial measurement unit for determining head yaw, head pitch, and head roll, when the user 1500 wears the binaural hearing system 100 in its intended operational position on the user 1500's head.

The head tracker 120 has tri-axis MEMS gyros (not shown) that provide information on head yaw, head pitch, and head roll, and has tri-axis accelerometers that provide information on three dimensional displacement of the head of the user 1500 in a way well-known in the art.

Thus, the head tracker 120 outputs a tracking signal containing information on the user 1500's current position and head orientation for processing in the binaural hearing system 100.

For example, when the head tracker 120 has detected no, or insignificant, head movements during determination of the transfer functions of the binaural filter based on the electronic monaural signal as disclosed above, the determined transfer functions are used to filter the electronic monaural signal and subsequently, when head movements are detected by the head tracker 120, the determined transfer functions are modified in accordance with the changed orientation of the head of the user 1500 as detected by the head tracker 120, e.g. the azimuth of the DOA is changed in accordance with the detected head yaw.

In other words, the DOA of the sound source in question may be determined based on the tracking signal 124 output by the head tracker 120 that is calibrated based on the electronic monaural signal 14 whenever the head of the user 1500 is kept still. In the binaural hearing system 100, spatial cues are added to the respective electronic monaural signals utilizing binaural filters with directional transfer functions.

For example, the electronic monaural signal (ref. numeral 14 in FIG. 2) is correlated with the sound propagating as an acoustic wave 1120, 1330 to the binaural hearing system 100 as received by microphones 24, 26, 28, 30 of the binaural hearing system 100 in order to determine directional transfer functions from the respective sound source 1200, 1300 to each of the microphones 24, 26, 28, 30, including the filter functions of the transmission paths from the sound source 1200, 1300 to each of the respective microphones 24, 26, 28, 30.

At each ear of the user 1500, a selected one of the determined directional transfer functions to microphones mounted at the ear in question, or a resulting directional transfer function determined from the determined directional transfer functions to microphones 24, 26; 28, 30 mounted at the ear in question, may then be used to filter the electronic monaural signal before conversion of the filtered signal into a signal that is transmitted to the ear at which the microphone in question is mounted so that the user 1500 will perceive the filtered signal to arrive from the DOA 1520, 1530 of the respective sound source 1200, 1300.

For example, it is well-known that directional transfer functions of a microphone positioned at the entrance to an ear canal of a user 1500 are good approximations to the respective left ear part or right ear part of the corresponding HRTFs of the user 1500.

The determined directional transfer functions may then be compared with HRTFs or approximate HRTFs to determine the HRTF or approximate HRTF that forms part of the determined directional transfer function and that HRTF or approximate HRTF may then be used to filter the electronic monaural signal before conversion of the filtered signal into a signal that is transmitted to the ear at which the microphone in question is mounted so that the user 1500 will perceive the filtered signal to arrive from the DOA 1520, 1530 of the sound source 1200, 1300.

For example, sound propagation may be described by a linear wave equation with a linear relationship between the electronic monaural signal and each of the output signals of the microphones 24, 26, 28, 30.

For example, in the time domain for a time invariant system, the electronic monaural signal x(n) and each of the output signals $y^k(n)$ fulfill the equation:

$$y^k(n)=g^k(n)*x(n)+v^k(n),$$

where (*) is the convolution operator, k is an index of the microphones, i.e. in FIG. 1 k=1, 2, 3, or 4, n is the sample index, $g^k$ is the impulse response of the filter function of the transmission paths 1120, 1530 from the respective sound source 1200, 1300 to the $k^{th}$ microphone, and $v^k$ is noise as received at the $k^{th}$ microphone. The impulse response of filter function $g^k(n)$ of the transmission paths from the sound source 1200, 1300 to the $k^{th}$ microphone includes room reverberations and the impulse response of the $k^{th}$ directional transfer function.

One way of determining the impulse response of the transfer functions $g^k(n)$ is to solve the following minimization problem:

$$\hat{g}^k(n) = \underset{g^k}{\arg\min} \sum_{k=1}^{N} \|y^k(n) - g^k(n) * x(n) + v^k(n)\|^p$$

wherein N=4, namely the total number of microphones, and p is an integer, e.g. p=2.

The minimization problem may also be solved for a set of selected microphones.

The minimization problem may also be solved in the frequency domain.

In a room with no, or insignificant, reverberations, the directional transfer function $G^k(f)$ with the impulse response $g^k(n)$ may be determined as the ratio between the electronic monaural signal in the frequency domain X(f) and the output signal of the $k^{th}$ microphone in the frequency domain $Y^k(f)$:

$$G^k(f) = \frac{Y^k(f)}{X(f)}$$

The impulse response $\hat{g}^k(n)$ of the transfer function $G^k(f)$ may then be used as the impulse response of the directional transfer function; or, the impulse response of the transfer function $\hat{g}^k(n)$ may be truncated to eliminate or suppress room reverberations and the truncated impulse response $\hat{g}^k(n)$ may be used as the impulse response of the directional transfer function.

Subsequently, at each ear of the user 1500, a selected one of the determined directional transfer functions, $\hat{g}^k(n)$ in the time domain and $G^k(f)$ in the frequency domain, of microphones mounted at the ear in question, or a resulting directional transfer function determined from the determined directional transfer functions of microphones mounted at the ear in question, may then be used to filter the electronic monaural signal before conversion of the filtered signal into a signal that is transmitted to the ear at which the microphone in question is mounted so that the user 1500 will perceive the filtered signal to arrive from the DOA of the sound source.

The determined directional transfer functions may also be compared with impulse responses of HRTFs or approximate HRTFs to determine the HRTF or approximate HRTF that forms part of the determined directional transfer function and that HRTF or approximate HRTF may then be used to filter the electronic monaural signal before conversion of the filtered signal into a signal that is transmitted to the ear at which the microphone in question is mounted, so that the user 1500 will perceive the filtered signal to arrive from the DOA of the sound source.

One example of determining directional transfer functions of the binaural filter is explained in detail below.

Figure 2:
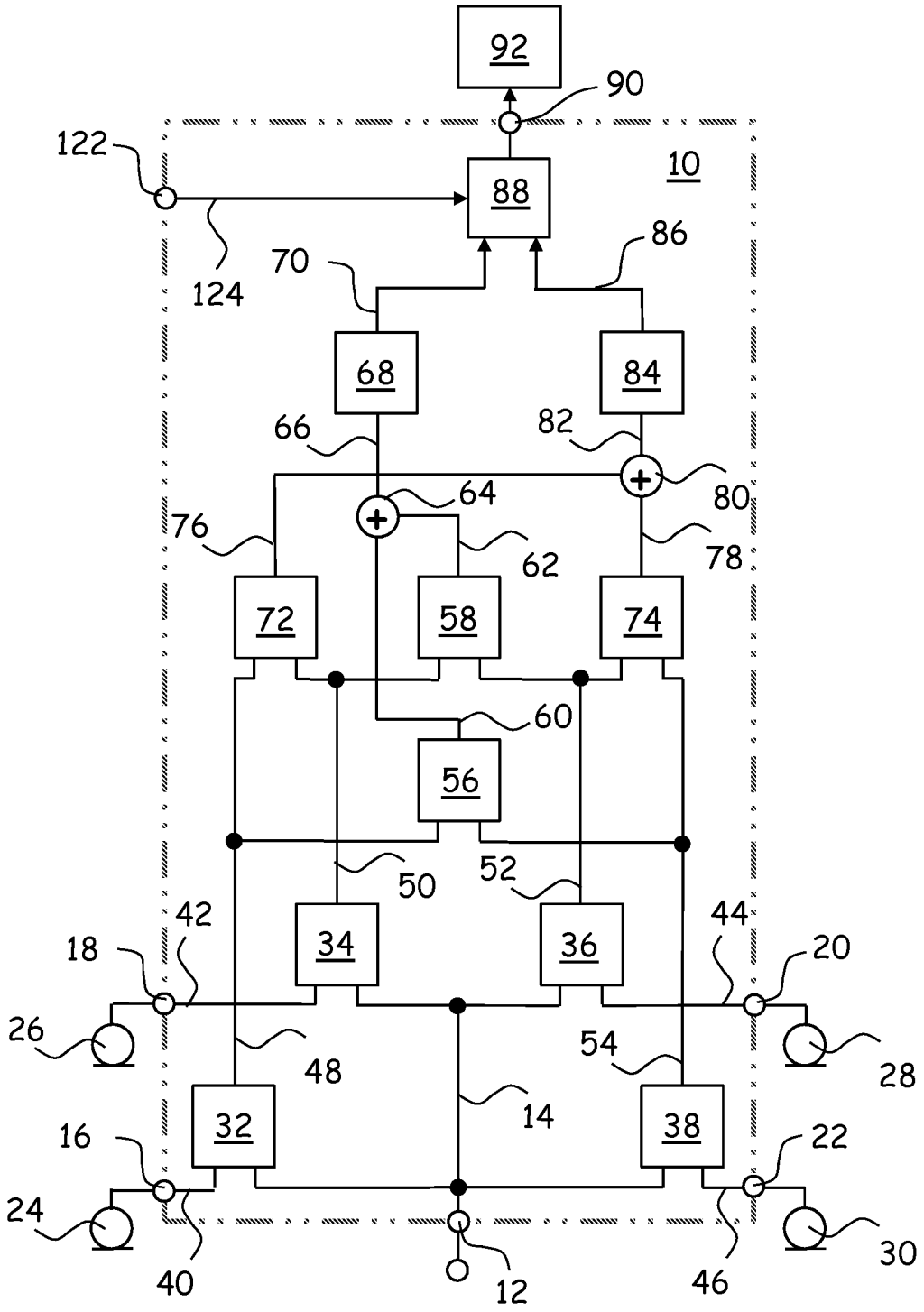
FIG. 2 shows a block diagram of one exemplified DOA estimator of the binaural hearing system.

FIG. 2 shows a block diagram of one example of a DOA estimator 10 of a binaural hearing system 100 according to the appended claims.

The DOA estimator 10 has an input 12 for reception of an electronic monaural signal 14 provided by a wireless receiver (not shown) of the binaural hearing system 100 (not shown). The wireless receiver (not shown) is adapted to receive the electronic monaural signal wirelessly from the respective monaural signal transmitter (not shown) out of a possible plurality of monaural signal transmitters (not shown). The monaural signal transmitter (not shown) is configured for transmission of the electronic monaural signal to the binaural hearing system 100, wherein the electronic monaural signal corresponds to sound emitted by a sound source (not shown) and propagating to the binaural hearing system 100 (not shown). The sound source (not shown) in question may be a speaking human (not shown) using a spouse microphone 1100 (not shown) for wireless transmission of the electronic monaural signal containing the speech to the binaural hearing system 100 (not shown).

The DOA estimator 10 has further inputs 16, 18, 20, 22 for connection with a right ear front microphone 24, a right ear rear microphone 26, a left ear front microphone 28 and a left ear rear microphone 30.

The binaural hearing system 100 has first and second housings (not shown), namely a right ear housing to be worn at the right ear of the user and a left ear housing to be worn at the left ear of the user 1500. The right ear housing (not shown) accommodates the right ear front microphone 24 and the right ear rear microphone 26, and the left ear housing (not shown) accommodates the left ear front microphone 30 and the left ear rear microphone 28 that can be used to form a directional microphone array at each ear of the user 1500 as is well-known, e.g., in the art of hearing aids.

The DOA estimator 10 has four correlating filters 32, 34, 36, 38 each of which correlates a respective one of the microphone output signals 40, 42, 44, 46 with the received and decoded electronic monaural signal 14 in order to enhance the sound emitted by the sound source (not shown) associated with the respective monaural signal transmitter (not shown) in the microphone signals.

Thus, the following correlations are performed, wherein * is the convolution operator:

In correlating filter 32 (Right ear—front microphone 24):

$$EF_RF(t)=\text{Hi}_RF(t)*Rm_n(-t)$$

wherein Hi_RF(t) is the output signal 40 of the front microphone 24 at the right ear, and EF_RF(t) is the corresponding enhanced output signal 48 of the correlating filter 32 established for the front microphone 24 at the right ear;

In correlating filter 34 (Right ear—rear microphone 26)

$$EF_RR(t)=\text{Hi}_RR(t)*Rm_n(-t)$$

wherein Hi_RR(t) is the output signal 42 of the rear microphone 26 at the right ear, and EF_RR(t) is the corresponding enhanced output signal 50 of the correlating filter 34 established for the rear microphone at the right ear;

In correlating filter 36 (Left ear—rear microphone 28)

$$EF_LR(t)=\text{Hi}_LR(t)*Rm_n(-t)$$

wherein Hi_LR(t) is the output signal 44 of the rear microphone 28 at the left ear, and EF_LR(t) is the corresponding enhanced output signal 52 of the correlating filter 36 established for the rear microphone 28 at the left ear;

In correlating filter 38 (Left ear—front microphone 30)

$$EF_LF(t)=\text{Hi}_LF(t)*Rm_n(-t)$$

wherein Hi_LF(t) is the output signal 46 of the front microphone 30 at the left ear, and EF_LF(t) is the corresponding enhanced output signal 54 of the correlating filter 38 established for the front microphone 30 at the left ear.

Alternatively, the cross-correlation can also be performed without time reversing the electronic monaural signal Rm_n (t).

By correlating the output signals 40, 42, 44, 46 of the microphones 24, 26, 28, 30 with the electronic monaural signal 14 from the respective monaural signal transmitter in the respective correlating filters 32, 34, 36, 38, the correlating filters 32, 34, 36, 38 provide enhanced output signals 48, 50, 52, 54 in which parts of the output signals 40, 42, 44, 46 of the microphones 24, 26, 28, 30 that correspond to the electronic monaural signal of the specific monaural signal transmitter, are enhanced.

In order to determine the ITD of the parts of the output signals 40, 42, 44, 46 that correspond to the electronic monaural signal, the enhanced signals of microphones worn at different ears are cross-correlated in correlating filters 56, 58:

In correlating filter 56 (Front microphones at different ears)

$$S_1(t)=EF_LF(t)*EF_RF(-t)$$

wherein $S_1(t)$ is the output signal 60 of the correlating filter 56, EF_LF(t) is the output signal 54 and EF_RF(t) is the output signal 48;

In correlating filter 58 (Rear microphones at different ears)

$$S_2(t)=EF_LR(t)*EF_RR(-t)$$

wherein $S_2(t)$ is the output signal 62 of the correlating filter 58, EF_LR(t) is the output signal 52 and EF_RR (t) is the output signal 50.

The cross-correlation outputs 60, 62 are added in adder 64 to form

S(t)=EF_LF(t)*EF_RF(−t)+EF_LR(t)*EF_RR(−t), wherein S(t) is the output signal 66 of the adder 64.

Then, the time lag r where S(t) has maximum is determined in ITD estimator 68 as the ITD.

Thus, the output signal 70 of the ITD estimator 68 is the ITD of the acoustic sound from the sound source associated with the specific monaural signal transmitter when received at the microphones 24, 26, 28, 30 worn at the left and right ears, respectively, of the user 1500.

In parallel, in order to determine whether the specific monaural signal transmitter resides in front of the user 1500 or behind the user 1500, the enhanced signals of front and rear microphones of the same ear are cross-correlated in correlating filters 72, 74:

In correlating filter 72 (Front and rear microphones at the left ear)

$$U_1(t)=EF_LF(t)*EF_LR(-t)$$

wherein $U_1(t)$ is the output signal 76 of the correlating filter 72, EF_LF(t) is the output signal 54 and EF_LR(t) is the output signal 52;

In correlating filter 74 (Front and rear microphones at the right ear)

$$U_2(t)=EF_RF(t)*EF_RR(-t)$$

wherein $U_2(t)$ is the output signal 78 of the correlating filter 74, EF_RF(t) is the output signal 48 and EF_RR(t) is the output signal 50.

The cross-correlation outputs 76, 78 are added in adder 80 to form

U(t)=EF_LF(t)*EF_LR(−t)+EF_RF(t)*EF_RR(−t), wherein U(t) is the output signal 82 of the adder 80.

Then, the time lag $\tau_2$ where U(t) has maximum is determined in front/back estimator 84.

The sign of $\tau_2$ determines if the specific monaural signal transmitter is located in front of, or behind, the user 1500.

Thus, the output signal 86 of front/back estimator 84 is the logical variable, namely the sign of $\tau_2$, indicating whether the sound source associated with the specific monaural signal transmitter is located in front of, or behind, the user 1500.

The azimuth estimator 88 has an output 90 for provision of the azimuth $\phi$ of the DOA of sound of the specific monaural signal transmitter determined based on ITD and $\tau_2$ and a table look-up.

Using a table look-up using a KEMAR HRTF database 92, the corresponding HRTF($\phi$, f) can be selected.

The information on the DOA is imparted onto the specific electronic monaural signal Rm_n(t) originating from the specific monaural signal transmitter by filtering (not shown, see FIG. 3) the specific electronic monaural signal Rm_n(t) with the selected HRTF($\phi$, f) with the binaural impulse response hrtf($\phi$, t), wherein hrtf_L($\phi$, t) is the left ear part and hrtf_R($\phi$, t) is the right ear part of the binaural impulse response:

$$Yn_L(t)=\text{hrtf}_L(\phi,t)*Rm_n(t)$$

$$Yn_R(t)=\text{hrtf}_R(\phi,t)*Rm_n(t)$$

and providing (not shown) Yn_L(t) to the left ear of the user 1500 and Yn_R(t) to the right ear of the user 1500.

In this way, the user 1500 perceives to listen to the specific electronic monaural signal Rm_n(t) as if the signal is arriving from the DOA of the sound source associated with the specific monaural signal transmitter.

The DOA estimator 10 has a further input 122 for connection with an output of the head tracker 120 (not shown) providing the tracking signal 124 to the DOA estimator.

The tracking signal 124 includes information of head yaw, i.e. changes in the azimuth of the DOA caused by the user 1500's head movement.

For example, when the head tracker 120 has detected no, or insignificant, head movements during determination of the transfer functions of the binaural filter based on the electronic monaural signal as disclosed above, the determined transfer functions are used to filter the electronic monaural signal and subsequently, when head movements are detected by the head tracker 120, the determined transfer functions are modified in accordance with the changed orientation of the head of the user 1500 as detected by the head tracker 120, e.g. the azimuth of the DOA is changed in accordance with the detected head yaw.

Figure 3:
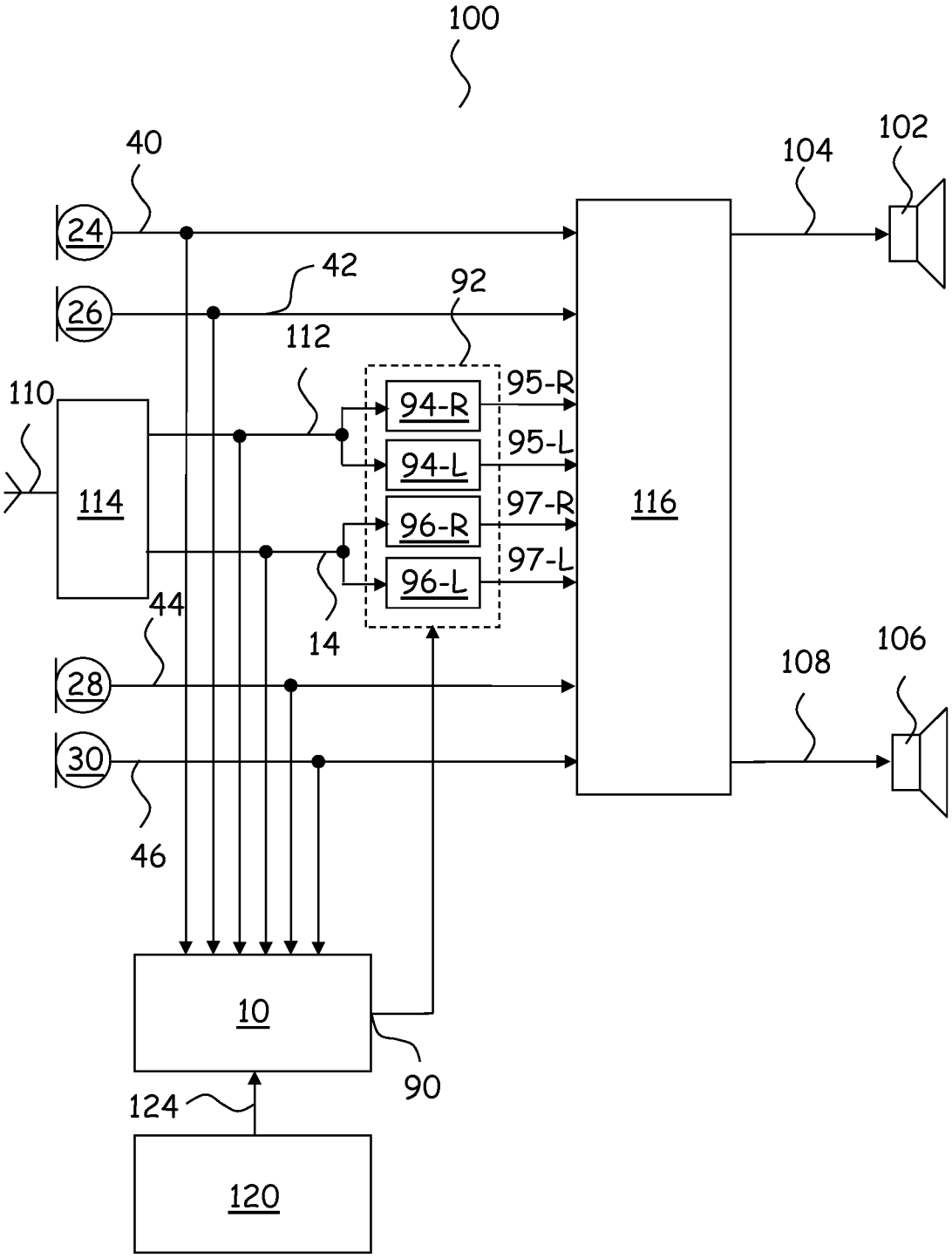
FIG. 3 shows a block diagram of an exemplified binaural hearing system.

In other words, the DOA of the sound source in question may be determined based on the tracking signal output by the head tracker 120 that is calibrated based on the electronic monaural signal whenever the head of the user 1500 is kept still, FIG. 3 shows a block diagram of an exemplified binaural hearing system 100, namely a binaural hearing aid comprising first and second housings (not shown) to be worn at the right ear and the left ear, respectively, of the user 1500.

The hearing aids of the binaural hearing aid 100 may be any type of hearing aid, such as Behind-The-Ear (BTE), Receiver-In-the-Ear (RIE), In-The-Ear (ITE), In-The-Canal (ITC), Completely-In-the-Canal (CIC), etc.

The first housing (not shown) is adapted to be worn at the right ear of the user 1500 and accommodates a first set of microphones, namely a first omni-directional front microphone 24 and a first omni-directional rear microphone 26, for conversion of sound arriving at the first set of microphones into a first set of corresponding microphone output signals 40, 42 that can be used to form a directional characteristic as is well-known in the art of hearing aids.

For In-The-Ear (ITE), In-The-Canal (ITC), Completely-In-the-Canal (CIC), hearing aids the first housing (not shown) also accommodates a first output transducer 102, namely a right ear receiver 102, for conversion of a first transducer audio signal 104 supplied to the right ear receiver 102 into a first sound signal propagating as an acoustic wave towards the eardrum of the right ear of the user 1500.

For Behind-The-Ear (BTE) hearing aids, the first housing (not shown) also accommodates the right ear receiver 102 and has a sound tube connected to the first housing for propagation of sound output by the receiver of the first housing and through the sound tube to an earpiece positioned and retained in the ear canal of the user 1500 and having an output port for transmission of the sound to the eardrum of the right ear canal.

For Receiver-In-the-Ear hearing aids, the first housing (not shown) is connected to a sound signal transmission member that comprises electrical conductors for propagation of the first transducer audio signal 104 to the right ear receiver 102 positioned in the earpiece for emission of sound through an output port of the earpiece towards the eardrum of the right ear canal.

The second housing (not shown) is adapted to be worn at the left ear of the user 1500 and accommodates a second set of microphones, namely a second omni-directional front microphone 30 and a second omni-directional rear microphone 28, for conversion of sound arriving at the second set of microphones into a second set of corresponding microphone output signals 44, 46 that can be used to form a directional characteristic as is well-known in the art of hearing aids.

For In-The-Ear (ITE), In-The-Canal (ITC), Completely-In-the-Canal (CIC), hearing aids the second housing (not shown) also accommodates a second output transducer 106, namely a left ear receiver 106, for conversion of a second transducer audio signal 108 supplied to the left ear receiver 106 into a second sound signal propagating as an acoustic wave towards the eardrum of the left ear of the user 1500.

For Behind-The-Ear (BTE) hearing aids, the second housing (not shown) also accommodates the left ear receiver 106 and has a sound tube connected to the second housing for propagation of sound output by the left ear receiver 106 of the second housing and through the sound tube to an earpiece positioned and retained in the ear canal of the user 1500 and having an output port for transmission of the sound to the eardrum of the left ear of the user 1500.

For Receiver-In-the-Ear hearing aids, the second housing (not shown) is connected to a sound signal transmission member that comprises electrical conductors for propagation of the second transducer audio signal 108 to the left ear receiver 106 positioned in the earpiece for emission of sound through an output port of the earpiece towards the eardrum of the left ear of the user 1500.

The output transducer may be a receiver positioned in the BTE hearing aid housing. In this event, the sound signal transmission member comprises a sound tube for propagation of acoustic sound signals from the receiver positioned in the BTE hearing aid housing and through the sound tube to an earpiece positioned and retained in the ear canal of the user 1500 and having an output port for transmission of the acoustic sound signal to the eardrum in the ear canal.

The output transducer may be a receiver positioned in the earpiece. In this event, the sound signal transmission member comprises electrical conductors for propagation of audio sound signals from the output of a signal processor in the BTE hearing aid housing through the conductors to a receiver positioned in the earpiece for emission of sound through an output port of the earpiece.

The binaural hearing aid 100 also comprises an electronic input 110, such as an antenna, a telecoil, etc., for provision of received electronic monaural signals 14, 112, each of which represents sound that is also propagating as an acoustic wave to the microphones 24, 26, 28, 30 of the binaural hearing aid 100. The electronic monaural signals 14, 112 are emitted by respective monaural signal transmitters (not shown) and received at the input 110.

Speech spoken by a human that the hearing aid user 1500 desires to listen to, may be recorded with a spouse microphone 1100 (not shown) carried by the human. The output signal of the spouse microphone 1100 is encoded for transmission to the electronic input 110 of the binaural hearing aid 100 using wireless data transmission. The wireless receiver 114 is connected to the electronic input 110 for reception of the transmitted data representing the spouse microphone output signal and decodes the received signal into the electronic monaural signal 14, 112.

The binaural hearing aid 100 also comprises the DOA estimator 10 which is shown in more detail in FIG. 2. In the DOA estimator 10 of FIG. 3, the circuitry shown in FIG. 2 has been duplicated into a number of similar circuits, one for each of a plurality of monaural signal transmitters transmitting electronic monaural signals Rm_n(t) to the electronic input 110 of the binaural hearing aid 100, wherein n is an index number identifying each of the monaural signal transmitters of the plurality of monaural signal transmitters.

In FIG. 3, the receiver 114 outputs two electronic monaural signals 14, 112, but it should be understood that the receiver 114 is capable of receiving and decoding a number N of electronic monaural signals, wherein N can be any number.

For each of the N electronic monaural signals 14, 112, the DOA estimator 10 provides the respective azimuth $\phi_n$ of the estimated $DOA_n$, for the $n^{th}$ electronic monaural signal to the HRTF database 92, e.g. KEMAR database. In the database 92, the appropriate HRTF($\phi_n$, f) are selected, e.g., using table look-up, and connected to the respective electronic monaural signal Rm_n(t).

This is illustrated in FIG. 3 for two electronic monaural signals 14, 112 out of an arbitrary number N of electronic monaural signals.

HRTF 94 is selected and connected to electronic monaural signal 112. HRTF 94 has a right ear part 94-R and a left ear part 94-L providing respective right ear output 95-R for the right ear and left ear output 95-L for the left ear. The binaural output signal 95-R, 95-L is provided to the hearing loss processor 116 that processes the signals in accordance with the hearing loss of the user 1500 and provides the hearing loss compensated signals 104, 108 to the respective receivers 102, 106 for transmission of sound to the user 1500.

HRTF 96 is selected and connected to electronic monaural signal 14. HRTF 96 has a right ear part 96-R and a left ear part 96-L providing respective right ear output 97-R for the right ear and left ear output 97-L for the left ear. The binaural output signal 97-R, 97-L is provided to the hearing loss processor 116 that processes the signals in accordance with the hearing loss of the user 1500 and provides the hearing loss compensated signals 104, 108 to the respective receivers 102, 106 for transmission of sound to the user 1500.

Thus, in general for each monaural signal transmitter (not shown) of the arbitrary number N of monaural signal transmitters, the microphone signals 40, 42, 44, 46 are correlated with the respective $n^{th}$ electronic monaural signal Rm_n(t) 14, 112 in correlating filters in order to enhance the sound emitted by the $n^{th}$ monaural signal transmitter in the microphone signals.

The respective azimuth $\phi_n$ of the DOA of the $n^{th}$ monaural signal transmitter is determined based on the filtered signals and the $n^{th}$ HRTF 94, 96 corresponding to the determined azimuth $\phi_n$ is selected for filtering the respective $n^{th}$ electronic monaural signal Rm_n(t) 14, 112 in order to impart spatial cues corresponding to the respective azimuth $\phi_n$ onto the $n^{th}$ electronic monaural signal Rm_n(t) in the output signals Yn_R(t) 95-R, 97-R, and Yn_L(t) 95-L, 97-L of the binaural filters 94, 96.

Finally, the resulting signals are added to form Y_L(t) 108 and Y_R(t) 104 provided to the left ear receiver 106 and right ear receiver 102, respectively, of the user 1500:

$$Y_L(t)=Y1_L(t)+Y2_L(t)+\ldots+Yn_L(t)+\ldots+YN_L(t)$$

$$Y_R(t)=Y1_R(t)+Y2_R(t)+\ldots+Yn_R(t)+\ldots+YN_R(t).$$

In this way, the user 1500 perceives to listen to each of the N electronic monaural signals Rm_n(t) as if each of the signals arrives from the DOA of the respective $n^{th}$ sound source associated with the respective monaural signal transmitter. Thus, the user 1500 will be able to separate individual sound sources associated with respective monaural signal transmitters and, e.g. focus his or her listening on a selected sound source. Further, the user 1500's ability to understand speech is improved due to the perceived externalization of the sound sources, and the user 1500's ability to understand speech from one sound source of a plurality of simultaneously speaking sound sources is improved.

The DOA estimator 10 has a further input 122 for connection with an output of the head tracker 120 providing the tracking signal 124 to the DOA estimator.

The tracking signal 124 includes information of head yaw, i.e. changes in the azimuth of the DOA caused by the user 1500's head movement.

For example, when the head tracker 120 has detected no, or insignificant, head movements during determination of the transfer functions of the binaural filter based on the electronic monaural signal as disclosed above, the determined transfer functions are used to filter the electronic monaural signal and subsequently, when head movements are detected by the head tracker 120, the determined transfer functions are modified in accordance with the changed orientation of the head of the user 1500 as detected by the head tracker 120, e.g. the azimuth of the DOA is changed in accordance with the detected head yaw.

In other words, the DOA of the sound source in question may be determined based on the tracking signal 124 output by the head tracker 120 that is calibrated based on the electronic monaural signal 14 whenever the head of the user 1500 is kept still, The binaural hearing system circuitry, e.g. as shown in FIGS. 2 and 3, may operate in the entire frequency range of the system 100.

The binaural hearing aid 100 shown in FIG. 3 may be a multi-channel binaural hearing aid 100 in which the microphone signals 40, 42, 44, 46 and the electronic monaural signals 14, 112 to be processed are divided into a plurality of frequency channels, and wherein the signals are processed individually in each of the frequency channels.

For a multi-channel binaural hearing aid 100, FIG. 3 may illustrate the circuitry and signal processing in a single frequency channel. The circuitry and signal processing may be duplicated in a plurality of the frequency channels, e.g. in all of the frequency channels.

For example, the signal processing illustrated in FIGS. 2 and 3 may be performed in a selected frequency band, e.g. selected during fitting of the hearing aid to a specific user 1500 at a dispenser's office.

The selected frequency band may comprise one or more of the frequency channels, or all of the frequency channels. The selected frequency band may be fragmented, i.e. the selected frequency band need not comprise consecutive frequency channels.

The plurality of frequency channels may include warped frequency channels, for example all of the frequency channels may be warped frequency channels.

The microphones 24, 26, 28, 30 may be connected conventionally to the hearing loss processor 116 of the binaural hearing aid 100 so that in some situations, conventional hearing loss compensation may be selected, and in other situations the filtered electronic monaural signals 95-R, 95-L, 97-R, 97-L may be selected for hearing loss compensation in processor 48.

An arbitrary number of microphones may substitute the front and rear microphones 24, 26, 28, 30 and selected output signals of the microphones may be combined to form one or more microphone signals 40, 42, 44, 46.

The components and circuitry of the binaural hearing system 100 may be distributed into different housings of the hearing system 100.

For example, the binaural hearing system 100 may have housings adapted to be worn at the left ear and the right ear, respectively, e.g. as is well-known in the art of hearing aids, and the microphones 24, 26, 28, 30 and output transducers, e.g. receivers, 102, 106 may be accommodated in the housings and possible earpieces as is well-known in the art of hearing aids. The DOA detectors and HRTFs may be duplicated so that both housings accommodate the DOA detectors and HRTFs.

Alternatively, one of the housings may only accommodate the microphones and the output transducer while all of the processing circuitry is accommodated in the other housing and signals are transmitted as appropriate between the housings.

The binaural hearing system 100 may further comprise a body worn device (not shown), such as a smart phone, and the body worn device may accommodate the DOA detectors and/or the HRTFs to exploit the power supply and processing power of the body worn device so that the first and second housings of the binaural hearing system 100 need only accommodate conventional parts of the binaural hearing system 100.

The body worn device (not shown) may accommodate a user interface of the binaural hearing system 100.

Although particular embodiments have been shown and described, it will be understood that it is not intended to limit the claimed inventions to the preferred embodiments, and it will be obvious to those skilled in the art that various changes and modifications may be made without department from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A binaural hearing system comprising:

a binaural hearing device having a first housing configured to be worn at a first ear of a user of the binaural hearing system, the first housing accommodating a first set of microphones that is configured to provide a first set of microphone output signals, a second housing configured to be worn at a second ear of the user, the second housing accommodating a second set of microphones that is configured to provide a second set of microphone output signals, a first output transducer configured to convert a first transducer audio signal into a first auditory output signal for reception by an auditory system of the user when the user wears the first housing at the first ear, and a second output transducer configured to convert a second transducer audio signal into a second auditory output signal for reception by the human auditory system when the user wears the second housing at the second ear;

an electronic monaural signal receiver configured to receive an electronic monaural signal provided by a monaural signal transmitter, wherein the electronic monaural signal is based on sound emitted by a sound source that is located at a distance to the user;

a direction of arrival estimator configured to correlate the first set of microphone output signals and/or the second set of microphone output signals with the electronic monaural signal, and to provide estimator output(s); and a binaural filter configured to process the electronic monaural signal with transfer function(s) based on the estimator output(s) for provision of the first and second transducer audio signals to the first and second output transducers, respectively, whereby the electronic monaural signal is perceivable by the user as arriving from the sound source;

wherein the direction of arrival estimator that is configured to correlate the first set of microphone output signals and/or the second set of microphone output signals with the electronic monaural signal and to provide the estimator output(s), is located in only one of the first housing and the second housing;

wherein the first housing is a part of a first hearing device, and the second housing is a part of a second hearing device; and wherein first hearing device comprises the direction of arrival estimator, and wherein the direction of arrival estimator is configured to provide at least one of the estimator output(s) for the binaural filter of the binaural hearing system.

2. The binaural hearing system according to claim 1, wherein the binaural hearing system is configured to receive the sound emitted by the sound source, so that at least a part of the first and second sets of microphone output signals corresponds to the electronic monaural signal.

3. The binaural hearing system according to claim 1, wherein the direction of arrival estimator is configured to estimate a direction of arrival of the sound by:

cross-correlating microphone output signal(s) from the first set of microphone output signals with the electronic monaural signal for provision of a first set of filtered microphone output signal(s), and cross-correlating microphone output signal(s) from the second set of microphone output signals with the electronic monaural signal for provision of a second set of filtered microphone output signal(s), and estimating the direction of arrival based on the first set of the filtered microphone output signal(s) and the second set of the filtered microphone output signal(s).

4. The binaural hearing system according to claim 1, wherein the direction of arrival estimator is configured to determine whether the sound source is located in front of the user or behind the user.

5. The binaural hearing system according to claim 4, wherein the direction of arrival estimator is configured to perform a cross-correlation based at least in part on microphone output signal(s) from the first set of microphone output signals and/or microphone output signal(s) from the second set of microphone output signals, and to determine a first time-lag at which a result of the cross-correlation has a maximum; and wherein the direction of arrival estimator is configured to determine whether the sound source is located in front of the user or behind the user based on a sign of the first time-lag.

6. The binaural hearing system according to claim 5, wherein the direction of arrival estimator is configured to estimate a direction of arrival of the sound based on an interaural time difference and the sign of the first time-lag.

7. The binaural hearing system according to claim 6, wherein the direction of arrival estimator is configured to determine a second time-lag.

8. The binaural hearing system according to claim 1, wherein the direction of arrival estimator is configured to cross-correlate microphone output signal(s) from the first set of microphone output signals with microphone output signal(s) from the second set of microphone output signals to obtain an output, and to estimate a direction of arrival based on the output.

9. The binaural hearing system according to claim 1, wherein the direction of arrival estimator is configured to estimate a direction of arrival based on an interaural time difference.

10. The binaural hearing system according to claim 1, wherein the first and second transducer audio signals provisioned by the binaural filter are: phase shifted with relation to each other based on an estimated direction of arrival of the sound, and/or amplified with a mutual gain difference based on the estimated direction of arrival of the sound.

11. The binaural hearing system according to claim 1, wherein the transfer function(s) corresponds with a Head Related Transfer Function.

12. The binaural hearing system according to claim 1, wherein the binaural filter is configured to process the electronic monaural signal in a plurality of frequency channels.

13. The binaural hearing system according to claim 1, further comprising a head tracker configured to be mounted at a head of the user for provision of a tracking signal containing information regarding a head movement of the user.

14. The binaural hearing system according to claim 1, further comprising a hearing loss processor that is configured to compensate for a hearing loss of the user.

15. The binaural hearing system according to claim 1, further comprising an additional direction of arrival estimator located in the second hearing device of the binaural hearing system.

16. The binaural hearing system according to claim 1, wherein the binaural hearing system comprises a headset, and wherein the first hearing device and the second hearing device are parts of the headset.

17. The binaural hearing system according to claim 1, wherein the binaural filter that is configured to process the electronic monaural signal with the transfer function(s) based on the estimator output(s) for provision of the first and second transducer audio signals to the first and second output transducers, is located in the one of the first housing and the second housing.

18. A binaural hearing system comprising:

a binaural hearing device having a first housing configured to be worn at a first ear of a user of the binaural hearing system, the first housing accommodating a first set of microphones that is configured to provide a first set of microphone output signals, a second housing configured to be worn at a second ear of the user, the second housing accommodating a second set of microphones that is configured to provide a second set of microphone output signals, a first output transducer configured to convert a first transducer audio signal into a first auditory output signal for reception by an auditory system of the user when the user wears the first housing at the first ear, and a second output transducer configured to convert a second transducer audio signal into a second auditory output signal for reception by the human auditory system when the user wears the second housing at the second ear;

an electronic monaural signal receiver configured to receive an electronic monaural signal provided by a monaural signal transmitter, wherein the electronic monaural signal is based on sound emitted by a sound source that is located at a distance to the user;

a direction of arrival estimator configured to correlate the first set and the second set of microphone output signals with the electronic monaural signal, and to provide estimator output(s); and a binaural filter configured to process the electronic monaural signal with transfer function(s) based on the estimator output(s) for provision of the first and second transducer audio signals to the first and second output transducers, respectively, whereby the electronic monaural signal is perceivable by the user as arriving from the sound source;

wherein the direction of arrival estimator that is configured to correlate the first set and the second set of microphone output signals with the electronic monaural signal and to provide the estimator output(s), is located in only one of the first housing and the second housing;

wherein the binaural filter that is configured to process the electronic monaural signal with the transfer function(s) based on the estimator output(s) for provision of the first and second transducer audio signals to the first and second output transducers, is located in the one of the first housing and the second housing;

wherein the first housing is a part of a first hearing device, and the second housing is a part of a second hearing device; and wherein first hearing device comprises the binaural filter, and is configured to transmit information regarding at least one of the transfer function(s) to the second hearing device.

19. A method of processing an electronic monaural signal in a binaural hearing system having a first set of microphones worn at a first ear of a user of the binaural hearing system, and a second set of microphones worn at a second ear of the user, the method comprising:

correlating (1) a first set of microphone output signals provided by the first set of microphones and/or a second set of microphone output signals provided by the second set of microphones, respectively, with (2) the electronic monaural signal, for provision of output(s); and processing the electronic monaural signal with transfer function(s) based on the output(s);

wherein the first set of microphones is located in a first housing of a first hearing device, the second set of microphones is located in a second housing of a second hearing device;

wherein the act of correlating (1) the first set of microphone output signals provided by the first set of microphones and/or the second set of microphone output signals provided by the second set of microphones, respectively, with (2) the electronic monaural signal, for provision of the output(s), is performed by a direction of arrival estimator located in only one of the first housing and the second housing; and wherein first hearing device comprises the direction of arrival estimator, and the method further comprises providing at least one of the output(s) by the direction of arrival estimator of the first hearing device for a component of the binaural hearing system.

20. The method according to claim 19, further comprising cross-correlating (1) microphone output signal(s) from the first set of microphone output signals and microphone output signal(s) from the second set of microphone output signals, respectively, with (2) the electronic monaural signal, for provision of first and second sets of filtered microphone output signals, respectively.

21. The method according to claim 20, wherein in the first set of filtered microphone output signals, at least a part of the first set of microphone output signals corresponding to the electronic monaural signal has been enhanced; and wherein in the second set of filtered microphone output signals, at least a part of the second set of microphone output signals corresponding to the electronic monaural signal has been enhanced.

22. The method according to claim 20, further comprising determining whether a sound source associated with the electronic monaural signal is located in front of the user or behind the user.

23. The method according to claim 19, wherein the act of processing the electronic monaural signal with the transfer function(s) based on the output(s), is performed for provision of first and second transducer audio signals respectively for a first output transducer of the first hearing device and a second output transducer of the second hearing device, and is performed by a binaural filter located in the one of the first hearing device and the second hearing device.

24. A method of processing an electronic monaural signal in a binaural hearing system having a first set of microphones worn at a first ear of a user of the binaural hearing system, and a second set of microphones worn at a second ear of the user, the method comprising:

correlating (1) a first set of microphone output signals provided by the first set of microphones and a second set of microphone output signals provided by the second set of microphones, respectively, with (2) the electronic monaural signal, for provision of output(s); and processing the electronic monaural signal with transfer function(s) based on the output(s);

wherein the first set of microphones is located in a first housing of a first hearing device, the second set of microphones is located in a second housing of a second hearing device;

wherein the act of correlating (1) the first set of microphone output signals provided by the first set of microphones and the second set of microphone output signals provided by the second set of microphones, respectively, with (2) the electronic monaural signal, for provision of the output(s), is performed by a direction of arrival estimator located in only one of the first housing and the second housing;

wherein the act of processing the electronic monaural signal with the transfer function(s) based on the output(s), is performed for provision of first and second transducer audio signals respectively for a first output transducer of the first hearing device and a second output transducer of the second hearing device, and is performed by a binaural filter located in the one of the first hearing device and the second hearing device; and wherein first hearing device comprises the binaural filter, and the method further comprises transmitting information regarding at least one of the transfer function(s) from the first hearing device to the second hearing device.

* * * * *